US010627744B1

(12) United States Patent
Hayashi

(10) Patent No.: US 10,627,744 B1
(45) Date of Patent: Apr. 21, 2020

(54) DEVELOPING DEVICE INCLUDING A MOVABLE MAGNETIC MEMBER AND IMAGE FORMING APPARATUS THEREWITH

(71) Applicant: KYOCERA Document Solutions Inc., Osaka (JP)

(72) Inventor: Masaki Hayashi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/554,105

(22) Filed: Aug. 28, 2019

(30) Foreign Application Priority Data

Oct. 3, 2018 (JP) ..... 2018-188493
Dec. 10, 2018 (JP) ..... 2018-230746

(51) Int. Cl.
*G03G 15/09* (2006.01)
*G03G 15/095* (2006.01)
*G03G 15/08* (2006.01)

(52) U.S. Cl.
CPC ..... *G03G 15/0921* (2013.01); *G03G 15/0812* (2013.01); *G03G 15/095* (2013.01); *G03G 15/0914* (2013.01); *G03G 15/0935* (2013.01); *G03G 15/0818* (2013.01); *G03G 15/0887* (2013.01); *G03G 2215/0614* (2013.01)

(58) Field of Classification Search
CPC ..... G03G 15/0818; G03G 15/0812; G03G 15/0898; G03G 15/0914; G03G 15/0921; G03G 15/0942; G03G 15/095; G03G 21/0058; G03G 21/0047; G03G 15/0241; G03G 15/0258
See application file for complete search history.

(56) References Cited

U.S. PATENT DOCUMENTS 4,563,978 A * 1/1986 Nakamura ..... G03G 15/0921 399/104
5,025,288 A * 6/1991 Kusuda ..... G03G 15/0126 399/229
5,998,080 A 12/1999 Ohno et al. ..... 430/110
6,035,169 A * 3/2000 Miyake ..... G03G 15/0808 399/258

(Continued)

FOREIGN PATENT DOCUMENTS

JP 2005-49574 A 2/2005

*Primary Examiner* — Walter L Lindsay, Jr.
*Assistant Examiner* — Arlene Heredia
(74) *Attorney, Agent, or Firm* — Stein IP, LLC

(57) ABSTRACT

A developing device includes a housing, a developer carrier, a regulating blade forming a regulating portion for regulating the layer thickness of developer on the developer carrier, a magnetic member arranged inside the developer carrier and having a plurality of magnetic poles including S and N poles, and a blade magnet inducing a magnetic pole at the tip end of the regulating blade. The magnetic member is movable between a first position where a magnetic pole having the same polarity as that of the facing magnetic pole of the blade magnet facing the developer carrier is arranged at a regulating portion and a second position where a magnetic pole having a different polarity is arranged at the regulating portion. The developing device can perform a first developer eliminating mode where the magnetic member is moved to a second position and the developer carrier is rotated forward during non-image forming period.

13 Claims, 21 Drawing Sheets

(56) References Cited

U.S. PATENT DOCUMENTS

| | | | | |
|---|---|---|---|---|
| 8,457,534 | B2 * | 6/2013 | Sakamaki ..... | G03G 15/0921 399/274 |
| 8,554,119 | B2 * | 10/2013 | Terai ..... | G03G 15/0921 399/272 |
| 9,335,666 | B2 * | 5/2016 | Sakamaki ..... | G03G 15/0921 |
| 10,175,633 | B2 * | 1/2019 | Hamakawa ..... | G03G 21/0064 |

* cited by examiner

DEVELOPING DEVICE INCLUDING A MOVABLE MAGNETIC MEMBER AND IMAGE FORMING APPARATUS THEREWITH

INCORPORATION BY REFERENCE

This application is based upon and claims the benefit of priority from the corresponding Japanese Patent Applications No. 2018-188493 filed on Oct. 3, 2018 and No. 2018-230746 filed on Dec. 10, 2018, the entire contents of which are incorporated herein by reference.

BACKGROUND

The present disclosure relates to a developing device used in an image forming apparatus such as a copier, printer, facsimile machine, or the like. More particularly, the present disclosure relates to a method for suppressing clogging of a gap between a developing roller and a regulating blade with developer.

A conventionally common developing system adopted in image forming apparatuses using an electrophotographic process typically uses powdery developer and involves a process of visualizing an electrostatic latent image formed on an image carrier such as a photosensitive drum with the developer, then transferring the visualized image (toner image) to a recording medium, and then fixing the image.

Developer is broadly classified into two-component developer comprising toner and magnetic carrier and one-component developer comprising non-magnetic or magnetic toner alone. As a development system using magnetic one-component developer, what is called a jumping one-component development system is known in which a fixed magnet with a plurality of magnetic poles is arranged inside the developing roller to carry toner in a developer container onto the developing roller using a magnetic carrying force and then thin toner layer is formed by regulating the layer thickness using the regulating blade to let toner fly to a photosensitive drum at a developing position.

In the magnetic one-component development system, the sufficient magnetic force is required at the tip end of the regulating blade for ensuring stability of the toner layer on the developing roller and for improving performance of electrostatic charging of toner. Thus, there is a known technique in which the magnetic force at the tip end of the regulating blade is enhanced by attaching a blade magnet on the side face of the regulating blade. However, attaching the blade magnet makes the toner likely to agglomerate inside the developing device around the blade magnet and at the tip end of the blade. As a result, the toner layer on the developing roller is disturbed and this makes an image failure such as white streaks likely to occur.

To avoid this, there is a known method for suppressing toner agglomeration in which a developer carrier is rotated reversely within a predetermined range when a temperature sensing member for sensing the temperature of the regulating member senses a temperature higher than a predetermined value. There is also a known method for improving the degradation of image quality due to a decline in image density and fogging with a white portion by, according to the environment and status of use of the image forming apparatus, changing the arrangement angle of a magnetic field generation means with a plurality of magnetic poles arranged inside the developer carrier.

SUMMARY

According to one aspect of the present disclosure, a developing device includes a housing, a developer carrier, a regulating blade, a magnetic member, and a blade magnet and develops an electrostatic latent image formed on an image carrier. The housing stores magnetic developer. The developer carrier is rotatably supported on the housing to carry developer on its outer circumferential face. The regulating blade is formed of a magnetic material and is arranged at a predetermined interval from the developer carrier. The regulating blade forms a regulating portion for regulating the layer thickness of the developer carried on the developer carrier. The magnetic member includes a shaft arranged inside the developer carrier and a plurality of magnetic poles including an S pole and an N pole fixed to an outer circumferential face of the shaft. The blade magnet is fixed to the regulating blade to induce a magnetic pole at the tip end of the regulating blade. The magnetic member is movable between a first position where a magnetic pole having the same polarity as that of a facing magnetic pole of the blade magnet facing the developer carrier is arranged at the regulating portion and a second position where a magnetic pole having a different polarity from the facing magnetic pole is arranged at the regulating portion. The developing device can perform a first developer eliminating mode in which the developer stagnating at the regulating portion is eliminated by, during non-image forming period, moving the magnetic member from the first position to the second position and rotating the developer carrier in a forward direction which is a rotation direction during image formation.

This and other objects of the present disclosure, and the specific benefits obtained according to the present disclosure, will become apparent from the description of embodiments which follows.

DETAILED DESCRIPTION

Figure 1:
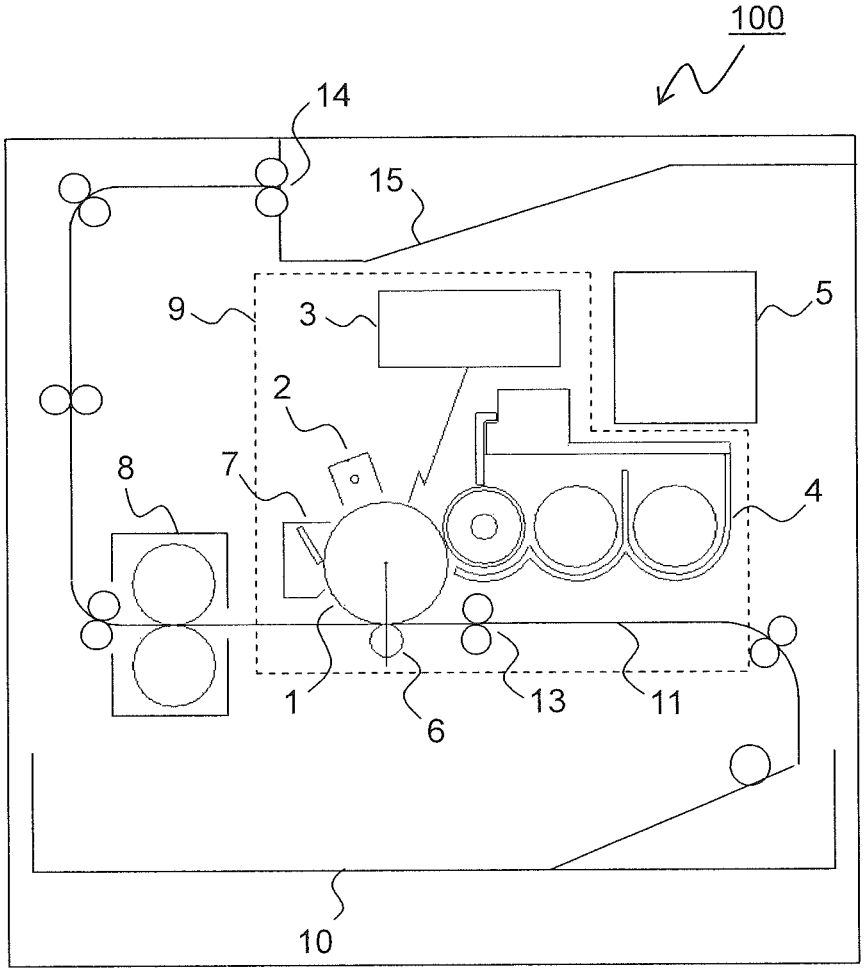
FIG. 1 is a schematic cross-sectional view of an image forming apparatus provided with a developing device according to one embodiment of the present disclosure.

Hereinafter, with reference to the accompanying drawings, embodiments of the present disclosure will be described. FIG. 1 is a schematic cross-sectional view of an image forming apparatus 100 provided with a developing device 4 according to one embodiment of the present disclosure. In the image forming apparatus (for example, a monochrome printer) 100, when a printing operation is performed, an electrostatic latent image based on document image data transmitted from a host device (unillustrated) such as a personal computer (hereinafter, referred to as PC) is formed in an image forming portion 9 inside an image forming apparatus 100, and the developing device 4 attaches toner to the electrostatic latent image to form a toner image. The toner is fed to the developing device 4 from a toner container 5. The image forming apparatus 100, while rotating a photosensitive drum 1 in a clockwise direction in FIG. 1, executes an image forming process with respect to the photosensitive drum 1.

In the image forming portion 9, there are provided, along the rotation direction of the photosensitive drum 1 (in the clockwise direction), a charging device 2, an exposure unit 3, the developing device 4, a transfer roller 6, a cleaning device 7, and a static eliminator (unillustrated). The photosensitive drum 1 is, for example, an aluminum drum coated with a photosensitive layer, and its surface can be electrostatically charged uniformly by the charging device 2. As the surface is irradiated with a laser beam from the exposure unit 3, which will be described later, the electric charge is so attenuated as to form an electrostatic latent image. Although there is no particular restriction on the photosensitive layer mentioned above, an amorphous silicon (a-Si) photosensitive layer which excels in durability or the like are preferable.

The charging device 2 electrostatically charges the surface of the photosensitive drum 1 uniformly. Used as the charging portion 2 is, for example, a corona discharge device which causes electric discharge by application of a high voltage to a thin piece of wire acting as an electrode. Usable Instead of a corona discharge device is a contact-type charging device which applies a voltage while keeping the surface of the photosensitive drum 1 in contact with a charging member as exemplified by a charging roller. The exposure unit 3 irradiates the photosensitive drum 1 with a light beam (for example, a laser beam) based on image data, and thereby forms an electrostatic latent image on the surface of the photosensitive drum 1.

The developing device 4 forms a toner image by attaching toner to the electrostatic latent image on the photosensitive drum 1. In this embodiment, magnetic one-component developer (hereinafter referred to as toner) comprising magnetic toner is stored in the developing device 4. The developing device 4 will be described in detail later. The cleaning device 7 is provided with a cleaning roller, cleaning blade, or the like that makes line contact with the photosensitive drum 1 in its longitudinal direction (the direction perpendicular to the plane of FIG. 1), and after the toner image is conveyed (transferred) to a sheet, the cleaning device 7 removes the toner that remains on the surface of the photosensitive drum 1.

Toward the photosensitive drum 1, where the toner image has now been formed as described above, a sheet is conveyed to the image forming portion 9 with predetermined timing from a sheet storage portion 10 through a sheet conveying passage 11 via a registration roller pair 13. The transfer roller 6 conveys (transfers), without disturbing, the toner image formed on the surface of the photosensitive drum 1 to the sheet conveyed through the sheet conveying passage 11. Then, in preparation for the subsequent formation of a new electrostatic latent image, the cleaning device 7 removes the unused toner on the surface of the photosensitive drum 1, and the static eliminator removes the remaining electric charge.

The sheet having the toner image transferred to it is separated from the photosensitive drum 1, and is conveyed to a fixing device 8, where, under application of heat and pressure, the toner image is fixed to the sheet. The sheet having passed through the fixing device 8 passes between a discharge roller pair 14, and is discharged onto a sheet discharge portion 15.

Figure 2A:
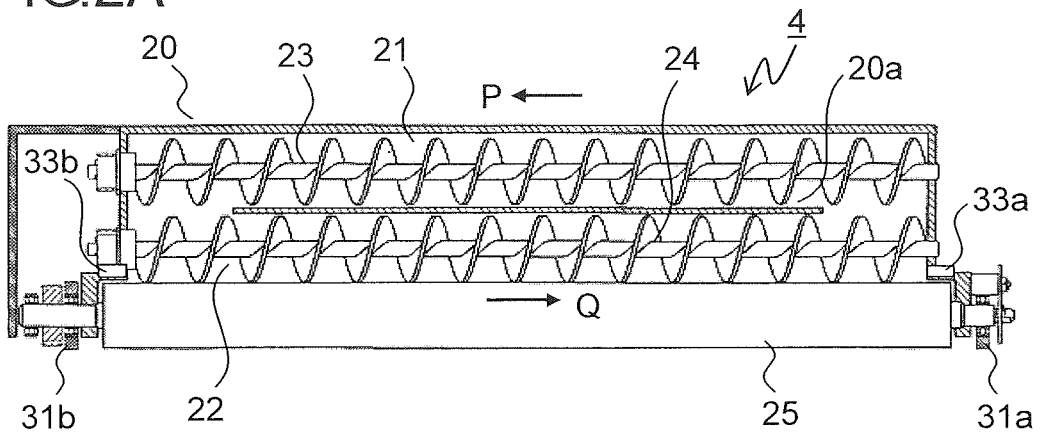
FIG. 2A is a plan view of the developing device according to a first embodiment of the present disclosure.
Figure 2B:
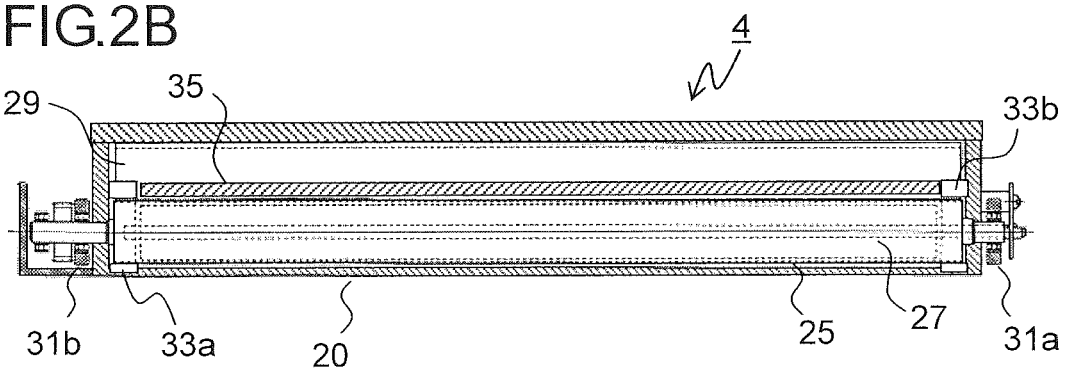
FIG. 2B is a front view of the developing device according to the first embodiment of the present disclosure.
Figure 3:
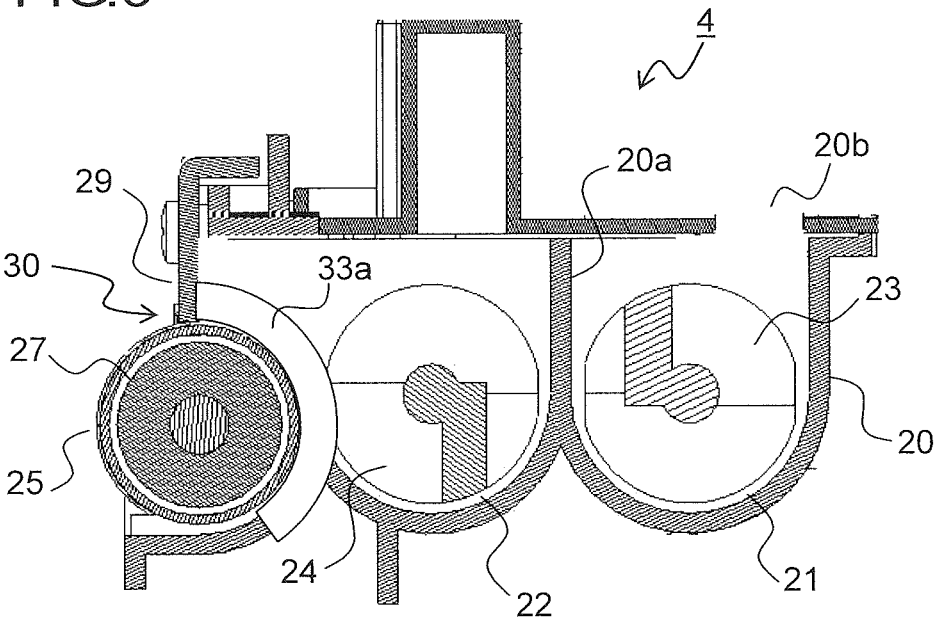
FIG. 3 is a side cross-sectional view of the developing device according to the first embodiment.

FIGS. 2A and 2B are a plan view and a front view of the developing device 4 according to a first embodiment of the present disclosure. FIG. 3 is a side sectional view of the developing device 4 in the first embodiment. FIG. 2A, for convenience, illustrates a state where a top cover is removed so that the inside can be seen. As shown in FIGS. 2 and 3, the inside of a housing 20 is partitioned into a first storage chamber 21 and a second storage chamber 22 by a partition wall 20*a* which is formed integrally with the housing 20. In the first storage chamber 21, a first stirring screw 23 is arranged, and in the second storage chamber 22, a second stirring screw 24 is arranged.

The first stirring screw 23 and the second stirring screw 24 are each configured to have a helical blade around a supporting shaft (rotary shaft), and they are rotatably pivoted on the housing 20 parallel to each other. As shown in FIG. 2A, there is no partition wall 20*a* in opposite end parts of the housing 20 in its longitudinal direction, that is, the axial direction of the first stirring screw 23 and the second stirring screw 24, and this permits toner to be passed between the first stirring screw 23 and the second stirring screw 24. With this, the first stirring screw 23 conveys the toner inside the first storage chamber 21, while stirring it, in an arrow P direction and then to the second storage chamber 22. The second stirring screw 24 conveys the toner conveyed to the second storage chamber 22, while stirring it, in an arrow Q direction and feeds it to a developing roller 25.

By rotating according to the rotation of the photosensitive drum 1 (see FIG. 1), the developing roller 25 feeds toner to the photosensitive layer on the photosensitive drum 1. Fixed inside the developing roller 25 is a fixed magnet 27 comprising a permanent magnet having a plurality of magnetic poles. With the magnetic force of the fixed magnet 27, toner is attached to (carried on) the surface of the developing roller 25 and a magnetic brush is formed. The developing roller 25 is rotatably pivoted on the housing 20 parallel to the first stirring screw 23 and the second stirring screw 24.

A regulating blade 29 is formed such that its width in the longitudinal direction (the left-right direction in FIG. 2) is larger than the maximum developing width, and by being arranged at a predetermined interval from the developing roller 25, forms a regulating portion 30 which regulates a toner amount (toner layer thickness) fed to the photosensitive drum 1. The regulating blade 29 comprises a magnetic material SUS (stainless steel) and the like.

At the bottom face of the second storage chamber 22 which faces the second stirring screw 24, there is provided a toner amount detection sensor (unillustrated) that detects the amount of toner stored inside the housing 20. Based on the detection result from this toner amount detection sensor, toner stored in the toner container 5 (see FIG. 1) is fed into the housing 20 via a developer feeding port 20*b* provided in an upper part of the housing 20.

DS rollers 31*a* and 31*b* are rotatably fitted around the rotary shaft of the developing roller 25. The DS rollers 31*a* and 31*b*, by touching the opposite ends of the outer circumferential face of the photosensitive drum 1 in the axial direction, strictly regulate the distance between the developing roller 25 and the photosensitive drum 1. A bearing is incorporated in each of the DS rollers 31*a* and 31*b*, and by rotating by following the photosensitive drum 1, it can prevent the drum surface from wearing. At the opposite ends of the developing roller 25 in the axial direction, magnetic seal members 33*a* and 33*b* are arranged for preventing toner from leaking through the gap between the housing 20 and the developing roller 25.

Figure 4:
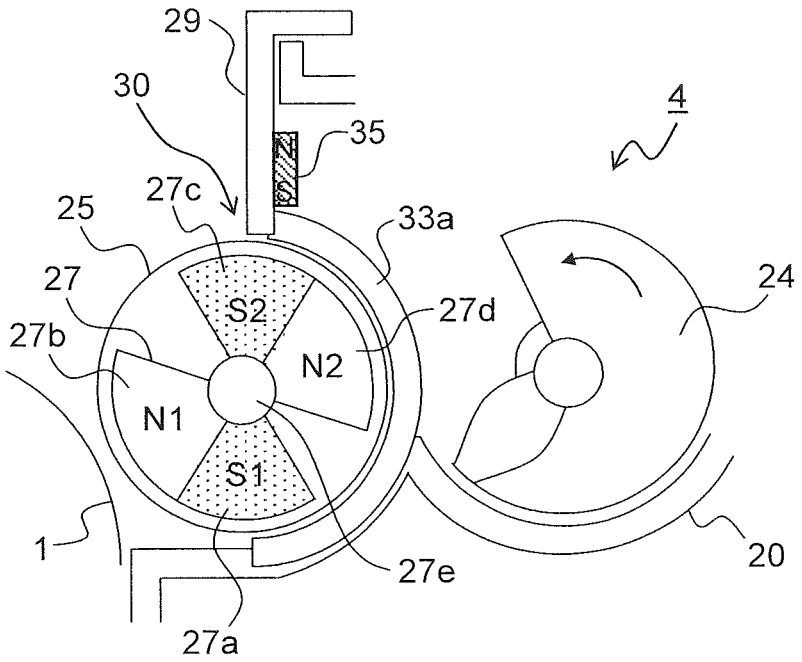
FIG. 4 is an enlarged view of and around a developing roller in the developing device in the first embodiment.
Figure 5:
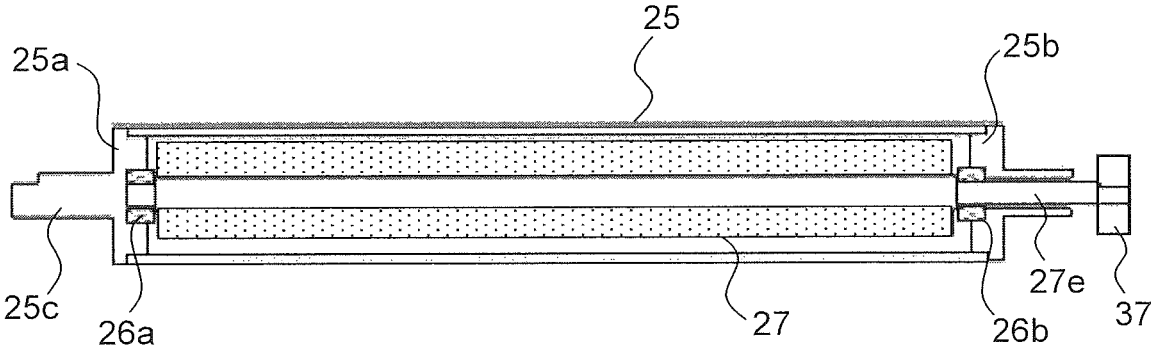
FIG. 5 is a cross-sectional view of the developing roller in FIG. 4 as seen from the direction perpendicular to its axial direction.

FIG. 4 is an enlarged view of and around the developing roller 25 in the developing device 4 in the first embodiment. FIG. 5 is a cross-sectional view of the developing roller 25 in FIG. 4 as seen from the direction perpendicular to its axial direction. As shown in FIG. 4, the fixed magnet 27 has, fixed to a metal shaft 27*e*, four magnetic poles 27*a* to 27*d* comprising an S1 pole 27*a*, an S2 pole 27*c*, an N1 pole 27*b*, and an N2 pole 27*d*.

As shown in FIG. 5, at both ends of the developing roller 25 in the longitudinal direction, flange parts 25*a* and 25*b* are attached, and to the flange part 25*a*, a drive input shaft 25*c* is fixed. A shaft 27*e* of the fixed magnet 27 is, at one end (the right end in FIG. 5), fixed to the housing 20 (see FIG. 3). Between the flange parts 25*a*/25*b* and the shaft 27*e*, bearings 26*a* and 26*b* are arranged. When a rotation driving force is input via a drive input gear (unillustrated) to the drive input shaft 25*c* from a developing drive motor 41 (see FIG. 6), the developing roller 25 rotates together with the flange parts 25*a* and 25*b*, but the fixed magnet 27 does not rotate.

To one end of the shaft 27*e*, a drive input gear 37 is fixed. To the drive input gear 37, a magnet drive motor 43 (see FIG. 6) is connected.

As shown back in FIG. 4, near the tip end of the regulating blade 29, a blade magnet 35 is attached. As shown in FIG. 2, the blade magnet 35 is attached between the magnetic seal members 33*a* and 33*b* substantially over the entire region of regulating blade 29 in the longitudinal direction (left-right direction in FIG. 2). The blade magnet 35 is, with the S pole down, in contact with the regulating blade 29, and at the tip end of the regulating blade 29, an N pole is induced. With this, a magnetic field is generated in the regulating portion 30 between the regulating blade 29 and the S2 pole (a regulating pole) 27*c* of the fixed magnet 27 in such a direction as to attract each other. The fixed magnet 27 is referred to as being in a first position when the magnetic pole (here, the S2 pole 27*c*) with the same polarity as the facing magnetic pole 35*a* of the blade magnet 35 facing the developing roller 25 is arranged so as to face the regulating blade 29.

By this magnetic field, a magnetic brush comprising chains of toner particles is formed between the regulating blade 29 and the developing roller 25. While the magnetic brush passes the regulating portion 30, its layer thickness is restricted to a desired height. On the other hand, toner unused in the magnetic brush formation stagnates along the upstream-side (right-side) side face of the regulating blade 29. Then, when the developing roller 25 rotates in the counter-clockwise direction and the magnetic brush moves to a region (a developing region) facing the photosensitive drum 1, a magnetic field is applied by the N1 pole (main pole) 27*b*, and the magnetic brush touches the surface of the photosensitive drum 1 to develop an electrostatic latent image.

When the developing roller 25 rotates further in the counter-clockwise direction, a magnetic field in the direction along the outer circumferential face of the developing roller 25 is now applied by the S1 pole (conveyance pole) 27*a*, and the magnetic brush is, together with the toner unused in the toner image formation, collected onto the developing roller 25. Furthermore, at a hollow portion between the S1 pole 27*a* and the N2 pole 27*d*, the magnetic brush separates from the roller 25 and falls into the housing 20. Then, after being stirred and conveyed by the second stirring screw 24, the magnetic brush is again formed on the developing roller 25 by the magnetic field of the N2 pole (scooping pole) 27*d*.

In the housing 20 which covers the both ends of the developing roller 25, magnetic seal members 33*a* and 33*b* are arranged. In FIG. 4, only the magnetic seal member 33*a* is illustrated. The magnetic seal members 33*a* and 33*b* are, as shown in FIG. 4, arranged at both ends of the developing roller 25 with no contact with the developing roller 25, that is, with a predetermined interval (gap) from the outer circumferential face of the developing roller 25. The magnetic seal members 33*a* and 33*b* are arranged opposite the photosensitive drum 1 across the developing roller 25.

Figure 6:
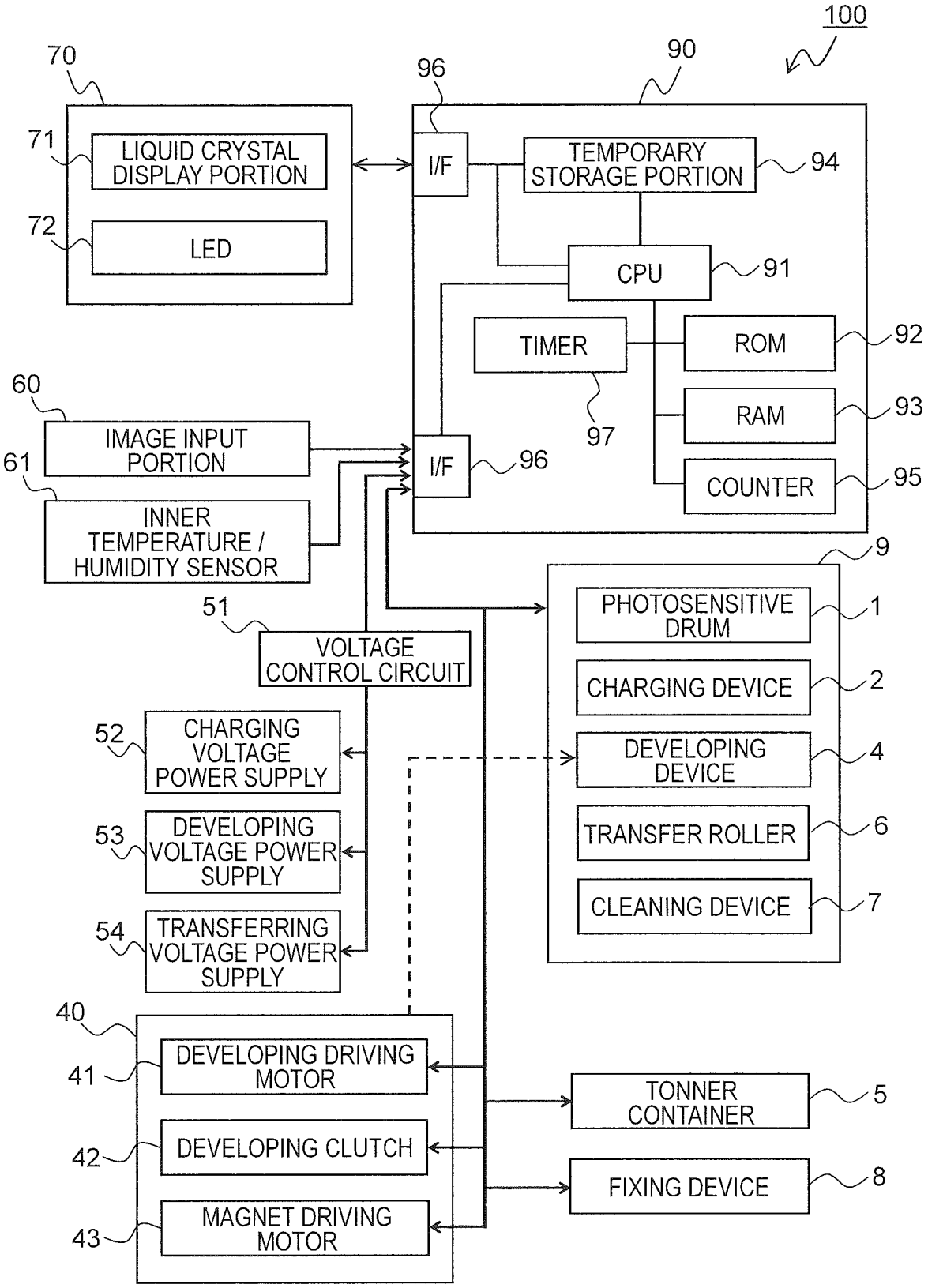
FIG. 6 is a block diagram showing one example of control paths used in the image forming apparatus.

FIG. 6 is a block diagram showing one example of control paths used in the image forming apparatus 100. When the image forming apparatus 100 is used, different parts of the device are controlled in different manners, and thus the control paths in the whole image forming apparatus 100 are complicated. Thus, the following description focuses on those control paths which are essential for the implementation of the present disclosure.

A developing driving portion 40 includes the developing drive motor 41, a developing clutch 42, and the magnet drive motor 43. The developing drive motor 41 drives to rotate the first stirring screw 23, the second stirring screw 24, and the developing roller 25. The developing clutch 42 turns on and off the rotation driving force input from the developing drive motor 41 to the first stirring screw 23, the second stirring screw 24, and the developing roller 25. The magnet drive motor 43 rotates the shaft 27*e* and thereby rotates the fixed magnet 27 fixed to the shaft 27*e* through a predetermined angle.

The voltage control circuit 51 is connected to a charging voltage power supply 52, a developing voltage power supply 53, and a transferring voltage power supply 54, and makes those power supplies operate according to output signals from the control portion 90. According to control signals from the voltage control circuit 51, predetermined voltages are respectively applied from the charging voltage power supply 52 to the wire inside the charging device 2, from the developing voltage power supply 53 to the developing roller 25 inside the developing device 4, and from the transferring voltage power supply 54 to the transfer roller 6.

An image input portion 60 is a reception portion for receiving image data transmitted to the image forming apparatus 100 from a PC or the like. The image signal input via the image input portion 60 is converted to a digital signal and is then transmitted to a temporary storage portion 94.

An inner temperature/humidity sensor 61 is for sensing the temperature and the humidity inside the image forming apparatus 100, especially around the developing device 4, and is arranged near the image forming portion 9.

An operation portion 70 has a liquid crystal display portion 71 and LEDs 72 that show different statuses, and is configured to display the status of the image forming apparatus 100, the status of image formation, the number of copies printed, and so on. Various settings of the image forming apparatus 100 are made via a printer driver on a PC.

The control portion 90 is provided at least with a CPU (central processing unit) 91, a ROM (read-only memory) 92 that is a read-only storage portion, a RAM (random access memory) 93 that is a readable-writable storage portion, the temporary storage portion 94 that temporarily stores image data and the like, a counter 95, a timer 97, a plurality of (here, two) I/Fs (interfaces) 96 which transmits control signals to different devices in the image forming apparatus 100 and receives input signals from the operation portion 70.

The ROM 92 stores data and the like that are not changed during the use of the image forming apparatus 100, such as control programs for the image forming apparatus 100 and numerical values needed for control. The RAM 93 stores necessary data generated during the control of the image forming apparatus 100, data temporarily needed to control the image forming apparatus 100, and the like. What is stored in the RAM 93 (or the ROM 92) includes a table (see Table 1) which defines the relationship of the cumulative drive time T of the developing device 4 counted by the timer 97 described later with the level of agglomeration at the regulating portion 30 (see FIG. 16) and the relationship of the cumulative drive time Tsum with the agglomeration coefficient and the toner degradation coefficient.

The temporary storage portion 94 temporarily stores an image signal that is input, after being converted to a digital signal, from an image input portion 60 which receives image data transmitted from a PC and the like. The counter 95 counts the number of printed sheets in a cumulative manner. The timer 97 separately counts the cumulative drive time Tsum (a first drive time) after the start of use of the developing device 4 and the cumulative drive time T (a second drive time) after the latest execution of the developer eliminating mode.

The control portion 90 transmits control signals to different parts and devices in the image forming apparatus 100 from the CPU 91 through the I/F 96. From the different parts and devices, signals that indicate their statuses and input signals are transmitted through the I/F 96 to the CPU 91. The different parts and devices controlled by the control portion 90 include, for example, the fixing device 8, the image forming portion 9, a developing driving portion 40, a voltage control circuit 51, an image input portion 60, and an operation portion 70.

As described previously, when continuous printing is performed in a high-temperature environment using a low melt toner as a magnetic one-component developer, the toner stagnating at the regulating portion 30 of the developing device 4 softens to cause blocking and clogging. As a solution, in this embodiment, a first developer eliminating mode can be performed during non-image forming period to eliminate the toner (developer) which stagnates at the regulating portion 30. Hereinafter, the first developer eliminating mode will be described in detail.

Figure 7:
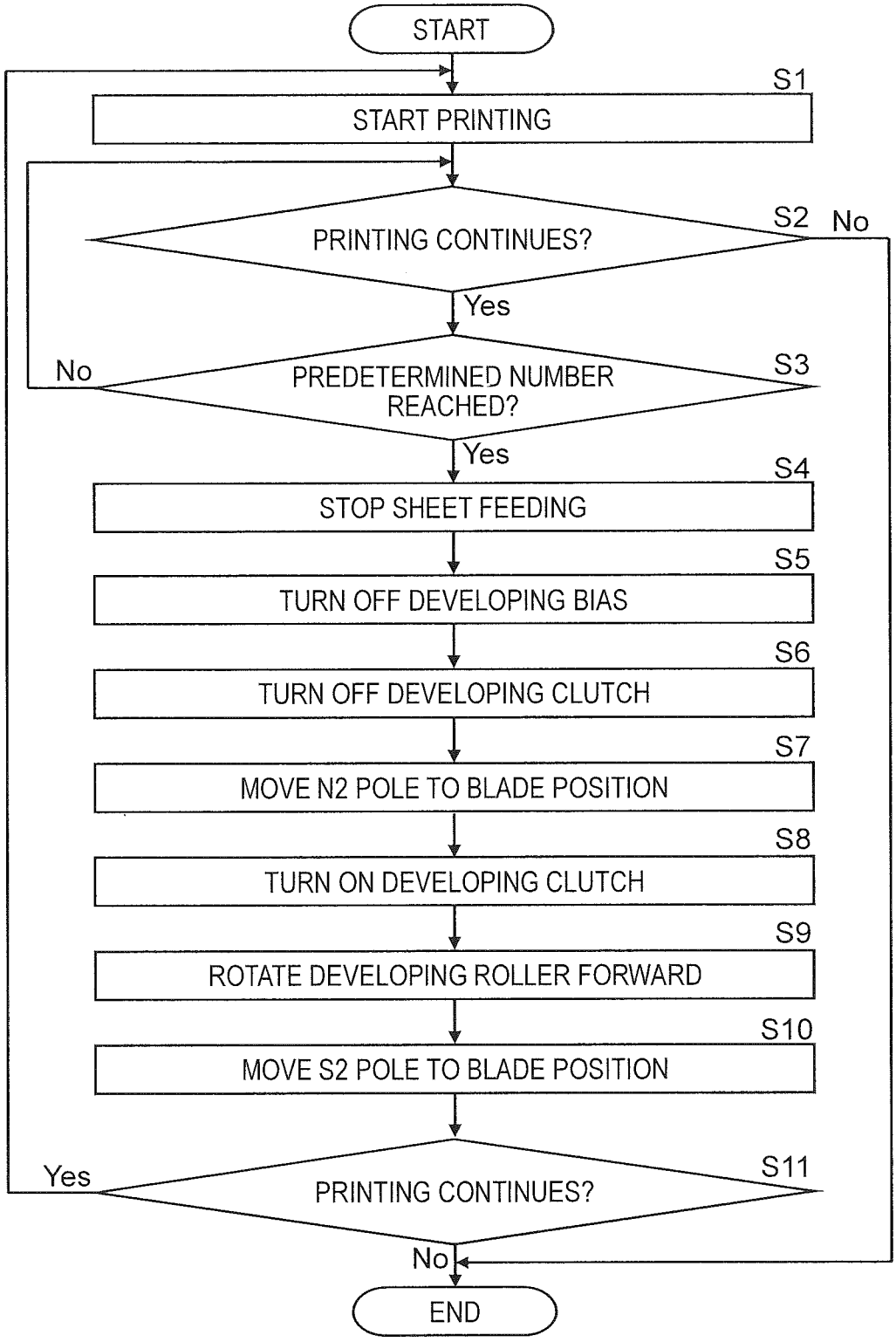
FIG. 7 is a flow chart showing an example of control in a first developer eliminating mode on the developing device of the first embodiment.

FIG. 7 is a flow chart showing an example of control in the first developer eliminating mode on the developing device 4 of the first embodiment. With reference also to FIGS. 1 to 6 as necessary, the procedure for performing the first developer eliminating mode will be described along the steps in FIG. 7.

When a printing instruction is input from a host device such as a PC and printing is started (step S1), the control portion 90 (see FIG. 6) checks whether printing continues or not (step S2). When printing continues, whether the number of printed sheets has reached a predetermined number or not is checked next (step S3). When the number of printed sheets has not reached the predetermined number (No in step S3), the procedure returns to step S2 and printing is continued. When printing ends before the number of printed sheets reaches a predetermined number (No in step S2), the procedure is finished.

When the number of printed sheets has reached the predetermined number (Yes in Step 3), sheet feeding from the sheet storage portion 10 is stopped according to a control signal from the control portion 90 (step S4). Application of a developing bias from the developing voltage power supply 53 (see FIG. 6) to the developing roller 25 is stopped (step S5), and the developing clutch 42 (see FIG. 6) is turned off (step S6) to stop the rotation of the developing roller 25.

Then, a control signal is transmitted from the control portion 90 to the magnet drive motor 43 (see FIG. 6) to make the fixed magnet 27 rotate through a predetermined angle in the rotation direction (the forward direction, the counter-clockwise direction in FIG. 4) of the developing roller 25 during image formation to move it to a position where the N2 pole (scooping pole) 27*d* faces the regulating blade 29 (step S7). The fixed magnet 27 is referred to as being in a second position when the magnetic pole (here, the N2 pole 27*d*) with the different polarity from the facing magnetic pole 35*a* of the blade magnet 35 is arranged so as to face the regulating blade 29.

Figure 8:
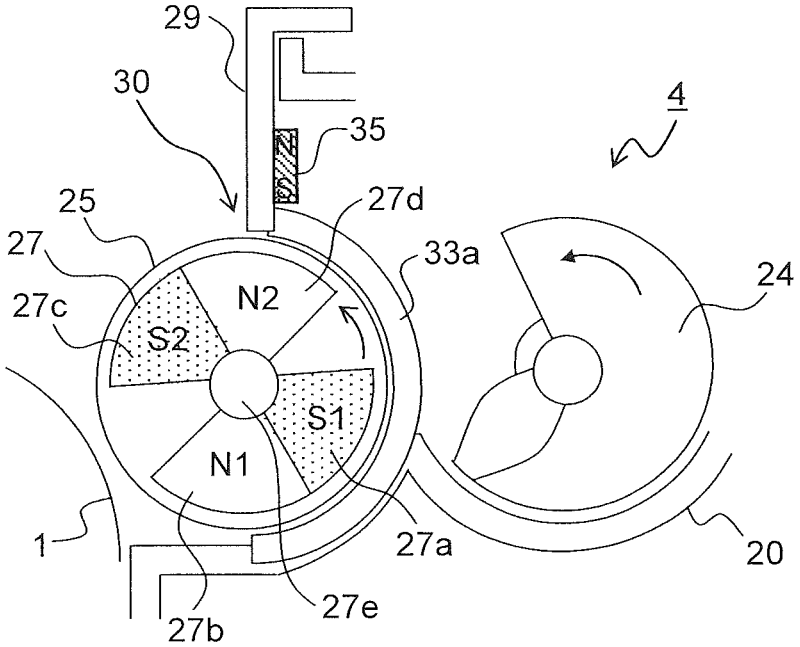
FIG. 8 is an enlarged view of and around the developing roller of the developing device, showing a state where an N2 pole of a fixed magnet has been moved to a position facing the regulating blade.
Figure 9:
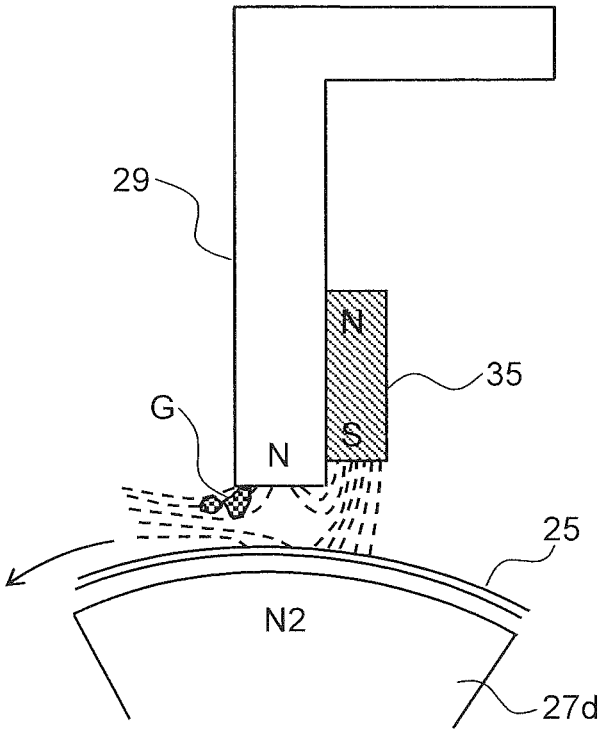
FIG. 9 is a partly enlarged view showing the direction of the magnetic field around the regulating portion in FIG. 8.

FIG. 8 is an enlarged view of and around the developing roller 25 of the developing device 4, showing a state where the N2 pole 27*d* of the fixed magnet 27 has been moved to a position facing the regulating blade 29. FIG. 9 is a partly enlarged view showing the direction of the magnetic field around the regulating portion 30 in FIG. 8. When the N2 pole 27*d* is arranged to face the regulating blade 29, as shown in FIG. 9, lines of magnetic force (indicated by a broken line in FIG. 9, a repulsive magnetic field) appear between the blade magnet 35 and the N2 pole 27*d*. Next, in the state in FIG. 8, the developing clutch 42 (see FIG. 6) is turned on (step S8), and the developing roller 25 is rotated in the forward direction (counter-clockwise direction in FIG. 8) (step S9). With this, as shown in FIG. 9, a force in the rotation direction of the developing roller 25 acts on the toner agglomerate G attached to the tip end of the regulating blade 29. As a result, the toner agglomerate G is eliminated from the tip end of the regulating blade 29.

Then, the fixed magnet 27 is rotated in the reverse direction (clockwise direction in FIG. 8) to return to the first position (see FIG. 4) where the S2 pole 27*c* faces the regulating blade 29 (step S10). The control portion 90 checks whether printing continues or not (step S11), and when printing continues (Yes in step S11), the procedure returns to step S1 to restart printing. When printing has ended (No in step S11), the procedure is finished.

According to the control shown in FIG. 7, by making the developing roller 25 rotate forward with the repulsive magnetic field generated between the regulating blade 29 and the developing roller 25, the toner agglomerate G attached to the tip end of the regulating blade 29 moves to the developing roller 25 side and attaches to it. The toner agglomerate G attached to the developing roller 25 rotates and moves downward by following the developing roller 25, and is collected into the housing 20 from the bottom end part of the developing roller 25.

Especially, when a low melt toner with a glass transition point (Tg) of 55° C. or lower is used in a developing system where the developing roller 25 has a line speed (processing speed) of 500 mm/sec or higher, even when continuous printing in a high-temperature environment is repeated, no toner agglomerate G stagnates at the regulating portion 30, suppressing blocking with toner due to heat and mechanical stress. It is thus possible to effectively prevent clogging with toner at the regulating portion 30 and the resulting image failure such as white streaks and vertical gray streaks.

Figure 10:
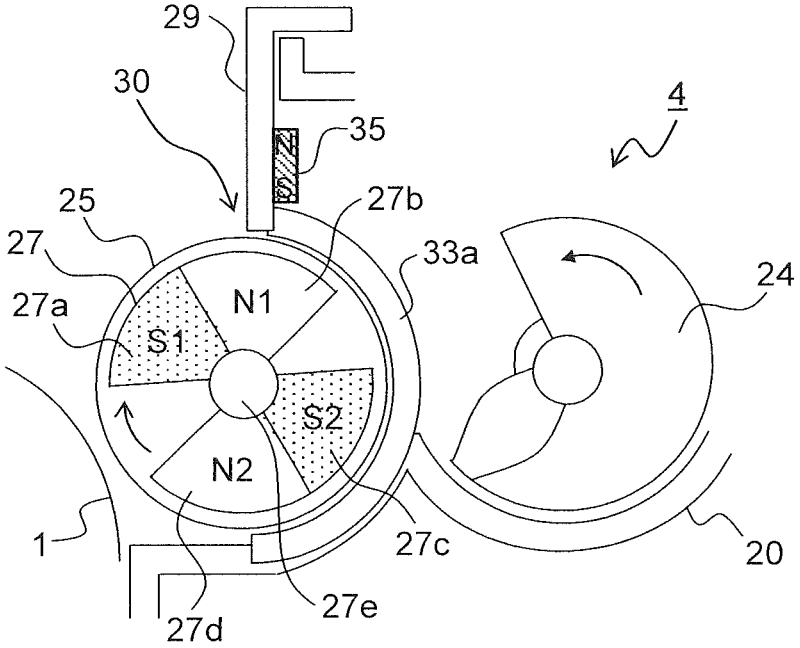
FIG. 10 is an enlarged view of and around the developing roller of the developing device, showing a state where the fixed magnet is rotated in the reverse direction to move an N1 pole to a position facing the regulating blade.

In the example of control in FIG. 7, the fixed magnet 27 is rotated in the forward direction (counter-clockwise direction in FIG. 8) to arrange the N2 pole 27*d* at a position facing the regulating blade 29. However, as shown in FIG. 10, the fixed magnet 27 may be rotated in the reverse direction (the clockwise direction in FIG. 8) to arrange the N1 pole (main pole) 27*b* at a position facing the regulating blade 29.

Figure 11:
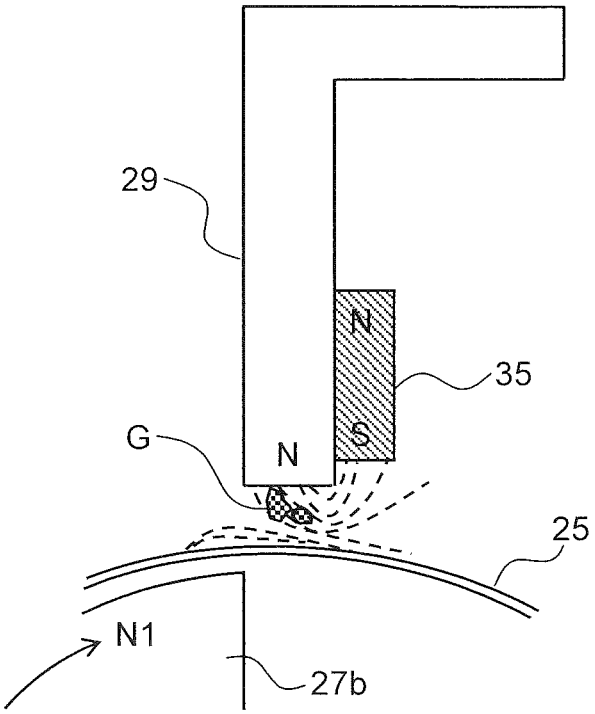
FIG. 11 is a partly enlarged view showing the direction of the magnetic field around the regulating portion when the fixed magnet is rotated in the reverse direction, illustrating a state where the N1 pole is approaching the regulating portion.
Figure 12:
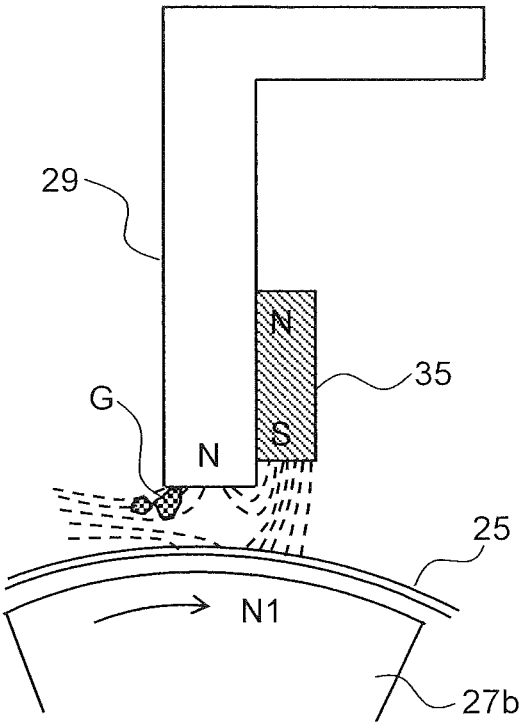
FIG. 12 is a partly enlarged view showing the direction of the magnetic field around the regulating portion when the fixed magnet is rotated in the reverse direction, illustrating a state where the N1 pole has passed the regulating portion.

FIGS. 11 and 12 are partly enlarged views showing the direction of the magnetic field around the regulating portion 30 when the fixed magnet 27 is rotated in the reverse direction, respectively illustrating a state where the N1 pole 27*b* is approaching the regulating portion 30 and a state where the N1 pole 27*b* has passed the regulating portion 30.

When the N1 pole 27*b* approaches the regulating portion 30 from the reverse direction (the left direction in FIG. 11), as shown in FIG. 11, lines of magnetic force (repulsive magnetic field) pointing inward of the developing device 4 (toward the right direction in FIG. 11) appear between the N pole induced at the tip end of the regulating blade 29 and the N1 pole 27*b*. By this repulsive magnetic field, the toner agglomerate G attached to the tip end of the regulating blade 29 is swung inward of the developing device 4 momentarily.

When the fixed magnet 27 rotates further in the reverse direction from the state in FIG. 11 and the N1 pole 27*b* passes the regulating portion 30, as shown in FIG. 12, the direction of the magnetic field between the N pole induced at the tip end of the regulating blade 29 and the N1 pole 27*b* is reversed, and lines of magnetic force (repulsive magnet field) pointing outward of the developing device 4 (toward the left direction in FIG. 12) appear. By this repulsive magnetic field, the toner agglomerate G is now swung outward of the developing device 4. In this way, the toner agglomerate G vibrates according to the change in the magnetic field, and thus a loosening effect through vibration can be expected, and this makes it easier to eliminate the toner agglomerate G when the developing roller 25 is rotated forward.

Furthermore, how frequently the first developer eliminating mode is performed may be changed according to the detection result from the inner temperature/humidity sensor 61. Specifically, by performing the first developer eliminating mode more frequently (shortening the interval) as the inner temperature becomes higher, it is possible to suppress agglomeration of toner and to prevent image failure effectively.

Instead of the inner temperature/humidity sensor 61, an outer temperature sensor for sensing the temperature outside the image forming apparatus 100 (the outer temperature) may be provided and the frequency of performing the first developer eliminating mode may be changed according to the temperature outside the device sensed by the outer temperature sensor.

Figure 13:
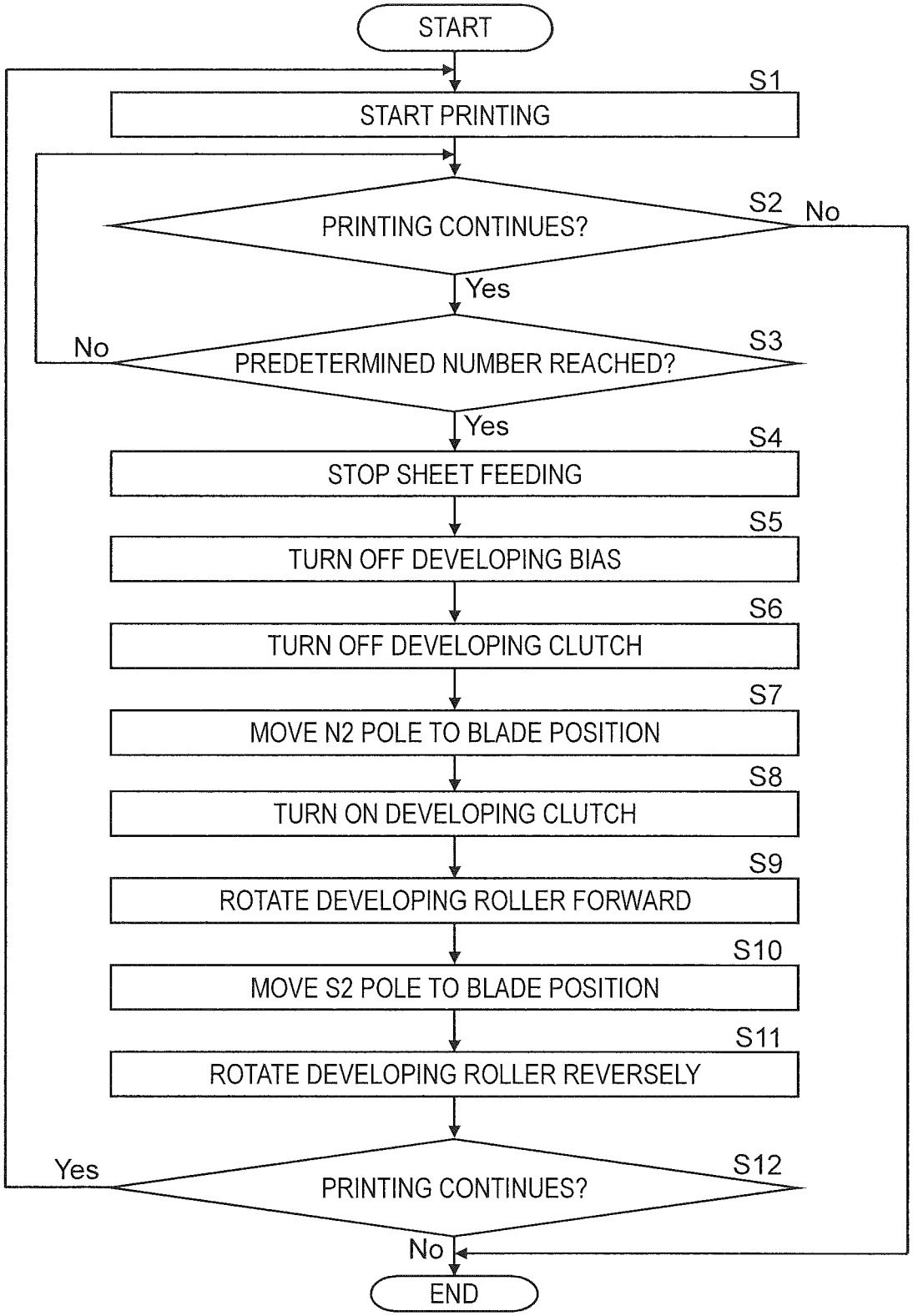
FIG. 13 is a flow chart showing an example of control in the first developer eliminating mode and a second developer eliminating mode on the developing device according to a second embodiment of the present disclosure.
Figure 14:
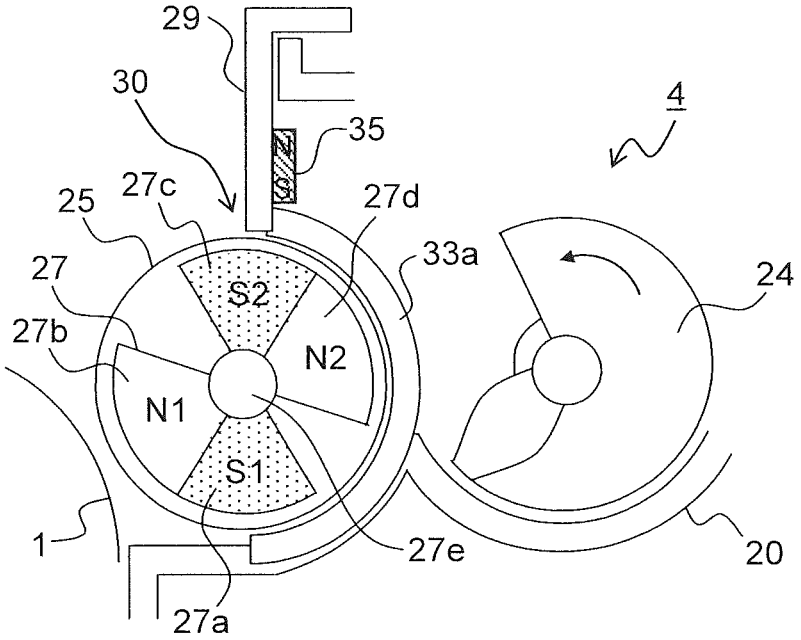
FIG. 14 is an enlarged view of and around the developing roller of the developing device according to the second embodiment, showing a state where an S2 pole of the fixed magnet has been moved to a position facing the regulating blade.
Figure 15:
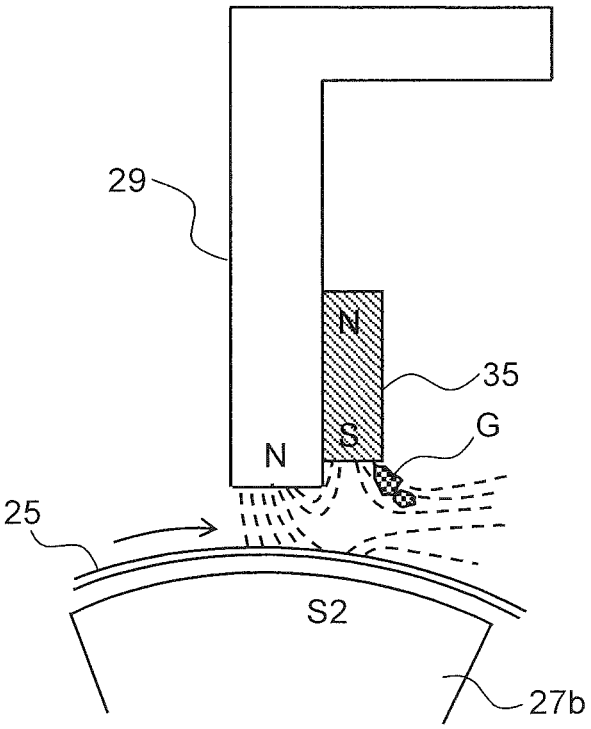
FIG. 15 is a partly enlarged view showing the direction of the magnetic field around the regulating portion in FIG. 14.

FIG. 13 is a flow chart showing an example of control in the first developer eliminating mode and a second developer eliminating mode on the developing device 4 according to a second embodiment of the present disclosure. FIG. 14 is an enlarged view of and around the developing roller 25 in the developing device 4, showing a state where the S2 pole 27*c* of the fixed magnet 27 in the developing device 4 of the second embodiment has been moved to a position facing the regulating blade 29. FIG. 15 is a partly enlarged view showing the direction of the magnetic field around the regulating portion 30 in FIG. 14. The configuration of the developing device 4 is similar to that in the first embodiment, and thus no overlapping description will be repeated.

In this embodiment, the N1 pole 27*b* or the N2 pole 27*d* of the fixed magnet 27 is moved to a position facing the regulating blade 29 (step S7), and the developing clutch 42 (see FIG. 6) is turned on (step S8) to rotate the developing roller 25 forward (step S9) and to perform the first developer eliminating mode. Next, the fixed magnet 27 is rotated in the reverse direction (clockwise direction in FIG. 8) from the state in FIG. 8 or in the forward direction (counter-clockwise direction in FIG. 10) from the state in FIG. 10 to arrange the S2 pole 27*c* at a position facing the regulating blade 29 as shown in FIG. 14 (step S10). Then, in that state, the developing roller 25 is rotated in the reverse direction (clockwise direction in FIG. 14) compared with that during the image formation (step S11) to perform the second developer eliminating mode. In other respects, the operation here is similar to that in the first embodiment shown in FIG. 7.

According to this embodiment, by arranging the S2 pole 27*c* having the same polarity as the blade magnet 35 (a polarity different from that induced at the tip end of the regulating blade 29) at a position facing the regulating blade 29, as shown in FIG. 15, a repulsive magnetic field is generated between the blade magnet 35 and the developing roller 25. In this state, by rotating the developing roller 25 reversely, a force in the rotation direction of the developing roller 25 acts on the toner agglomerate G around the blade magnet 35. As a result, the toner agglomerate G is eliminated from the tip end of the blade magnet 35.

In this way, by performing the second developer eliminating mode subsequently to the first developer eliminating mode, the toner agglomerate G attached to the tip end of the regulating blade 29 and the toner agglomerate G attached to the tip end of the blade magnet 35 can both be eliminated effectively.

While the first developer eliminating mode is performed, as shown in FIG. 10, if the fixed magnet 27 is rotated in the reverse direction (clockwise direction) to arrange the N1 pole (main pole) 27*b* at a position facing the regulating blade 29, when the second developer eliminating mode is performed, the fixed magnet 27 is rotated forward (in the counter-clockwise direction) to arrange the S2 pole 27*c* at a position facing the regulating blade 29.

Here, the S2 pole 27*c* approaches the facing magnetic pole 35*a* (S pole) of the blade magnet 35 from inside the developing device 4, a repulsive magnetic field pointing outward of the developing device 4 is generated between the facing magnetic pole 35*a* and the S2 pole 27*c*. With this, the toner agglomerate G attached to the tip end of the blade magnet 35 is swung outward of the developing device 4 (toward the left direction in FIG. 15) momentarily. Then, when the S2 pole 27*c* passes the blade magnet 35, the direction of the repulsive magnetic field is reversed to point inward of the developing device 4 (toward the right direction in FIG. 15), and thereby the toner agglomerate G is now swung inward of the developing device 4. Thus, a loosening effect through vibration can be expected, and this makes it easier to eliminate the toner agglomerate G when the developing roller 25 is rotated reversely.

As in the first embodiment, it is possible to change the frequency of performing the first and second developer eliminating modes according to the detection result from the inner temperature/humidity sensor 61.

Figure 16:
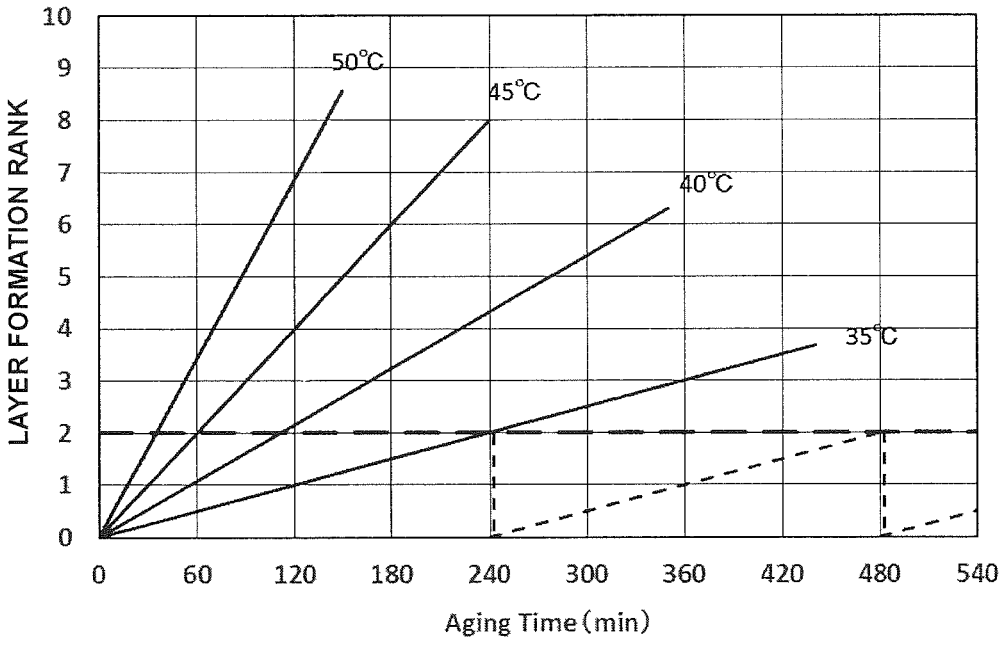
FIG. 16 is a chart showing the relationship of the developing drive time T with the level of agglomeration at the regulating portion.

Next, a third embodiment of the present disclosure will be described. FIG. 16 is a chart showing the relationship of the developing drive time T with the level of agglomeration (layer formation rank) at the regulating portion 30. As will be clear from FIG. 16, the developing drive time T and the level of agglomeration are correlated to each other, and the longer the developing drive time T, the higher the level of agglomeration. As indicated by the gradients of the plots in FIG. 16, the degree of increase of the level of agglomeration with respect to the developing drive time T (hereinafter referred to as an agglomeration coefficient) changes according to the temperature, and the higher the temperature, the larger the inclination.

Thus, in this embodiment, the timing of performing the first developer eliminating mode is determined based on the developing drive time T. Specifically, based on the developing drive time T, whether the level of agglomeration has reached a first level (here, level 2) or not is checked, and when it reaches the first level, the first developer eliminating mode is performed.

Here, with consideration given to temperature dependency of the agglomeration coefficient, the developing drive time T at each different temperature is converted into the drive time Tst at a reference temperature S.

$$Tst=T\times(a_N/a_S) \tag{1}$$

where a_S is the agglomeration coefficient at the reference temperature S, and a_N is the agglomeration coefficient at the temperature N.

Figure 17:
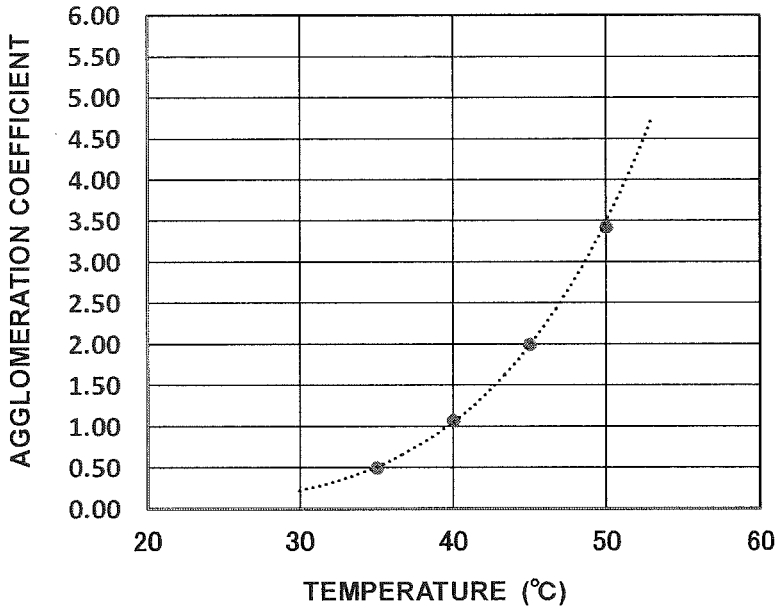
FIG. 17 is a chart showing the temperature dependency of the agglomeration coefficient a_N.

FIG. 17 is a chart showing the temperature dependency of the agglomeration coefficient a_N. For example, assuming that the reference temperature S is 35° C., when the developing drive time T at 40° C. is 120 (mins), according to FIG. 17, the agglomeration coefficient at 35° C. is (a_35)=0.5 and the agglomeration coefficient at 40° C. is (a_40)=1.0, and thus, based on formula (1), Tst=120×(1.0/0.5)=240 (mins). According to FIG. 16, when the developing drive time T at 35° C. is 240 mins, the level of agglomeration is level 2, and thus, as indicated by a broken line in FIG. 16, the first developer eliminating mode is performed at intervals of 240 mins.

Incidentally, as toner in the developing device 4 degrades, the level of agglomeration becomes higher, and thus it is preferable to determine the frequency of performing the first developer eliminating mode with consideration given to the degree of toner degradation. Thus, in this embodiment, with consideration given to the degree of toner degradation, the calculated drive time Tcal is calculated according to the following formula (2).

$$Tcal=T\times(a_N/a_S)\times\alpha \tag{2}$$

where $\alpha$ is the toner degradation coefficient.

Figure 18:
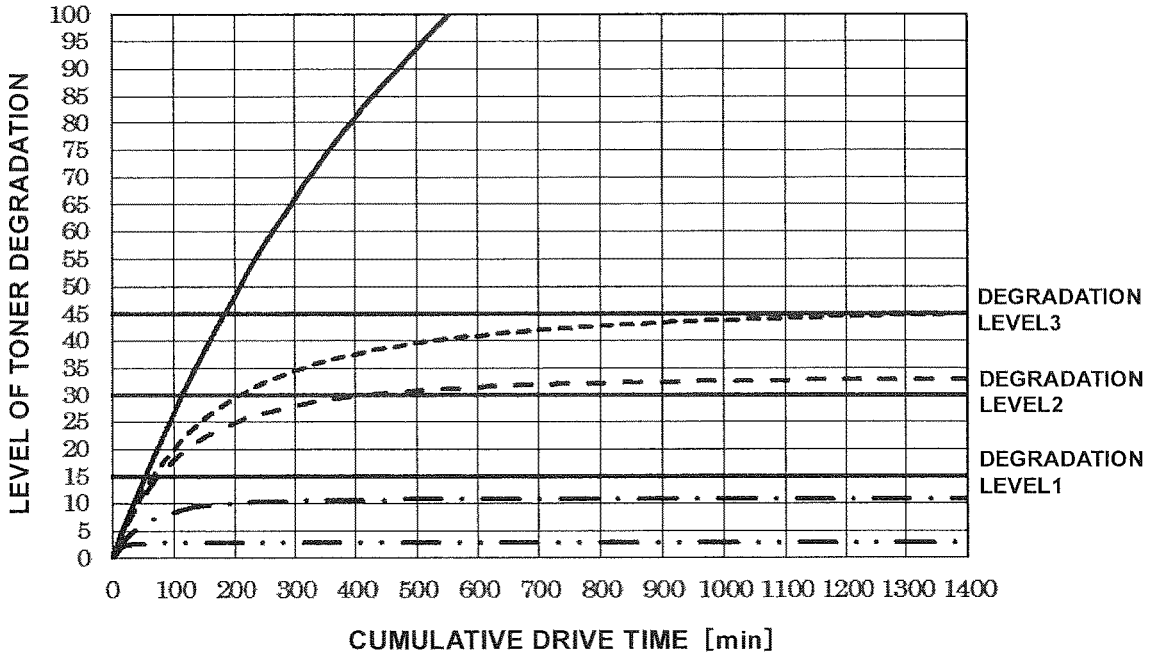
FIG. 18 is a chart showing the characteristics of toner degradation at each different printing rate.

The toner degradation coefficient $\alpha$ is determined according to the printing rate and the cumulative drive time Tsum (first drive time) of the developing device 4. In general, the lower the printing rate and the longer the cumulative drive time Tsum, the higher the degree of toner degradation. FIG. 18 is a chart showing the characteristics of toner degradation at each different printing rate. In FIG. 18, the characteristics of toner degradation at printing rates of 1%, 3.8%, 5%, 10%, and 50% are respectively indicated by a solid-line, a dotted line, a broken line, a dash-dot line, and a dash-dot-dot line. Table 1 shows the relationship among the degree of toner degradation calculated based on the chart in FIG. 18, the toner degradation coefficient α, the printing rate, and the cumulative drive time Tsum.

TABLE 1

| Printing Rate [%] | Cumulative Drive time Tsum [mins] | | |
|---|---|---|---|
| 1.0 or lower | 50 or longer | 117 or longer | 183 or longer |
| 3.8 or lower | 66.6 or longer | 200 or longer | 1283 or longer |
| 5.0 or lower | 83.3 or longer | 400 or longer | — |
| Degree of Toner Degradation | Degree of Degradation 1 | Degree of Degradation 2 | Degree of Degradation 3 |
| Toner Degradation Coefficient | ×1.5 | ×2 | ×5 |

Based on FIG. 18, when the printing rate is 1% or lower and the cumulative drive time Tsum is 50 mins or longer, or when the printing rate is 3.8% or lower and the cumulative drive time Tsum is 66.6 mins or longer, or when the printing rate is 5% or lower and the cumulative drive time Tsum is 83.3 mins or longer (the level of toner degradation is 15 or higher), the degree of toner degradation is evaluated as 1 and, as shown in Table 1, the toner degradation coefficient α is set at 1.5.

Similarly, when the printing rate is 1% or lower and the cumulative drive time Tsum is 117 mins or longer, or when the printing rate is higher than 1% and lower than or equal to 3.8% and the cumulative drive time Tsum is 200 mins or longer, or when the printing rate is higher than 3.8% or lower than or equal to 5% and the cumulative drive time Tsum is 400 mins or longer (the level of toner degradation is 30 or higher), the degree of toner degradation is evaluated as 2 and, as shown in Table 1, the toner degradation coefficient α is set at 2. When the printing rate is 1% or lower and the cumulative drive time Tsum is 183 mins or longer, or when the printing rate is 3.8% or lower and the cumulative drive time Tsum is 1283 mins or longer (the level of toner degradation is 45 or higher), the degree of toner degradation is evaluated as 3 and, as shown in Table 1, the toner degradation coefficient α is set at 5.

When the printing rate is higher than 3.8% but lower than or equal to 5% (between the dotted line and the broken line in FIG. 18), if the cumulative drive time Tsum is 400 mins or longer, the progress of the level of degradation due to an increase in the cumulative drive time Tsum and the refreshing of toner through printing are in equilibrium, and the degree of toner degradation does not change from 2 to 3. When the degree of toner degradation is less than 1, or when the printing rate exceeds 5%, the toner degradation coefficient α is set at 1 uniformly.

Figure 19:
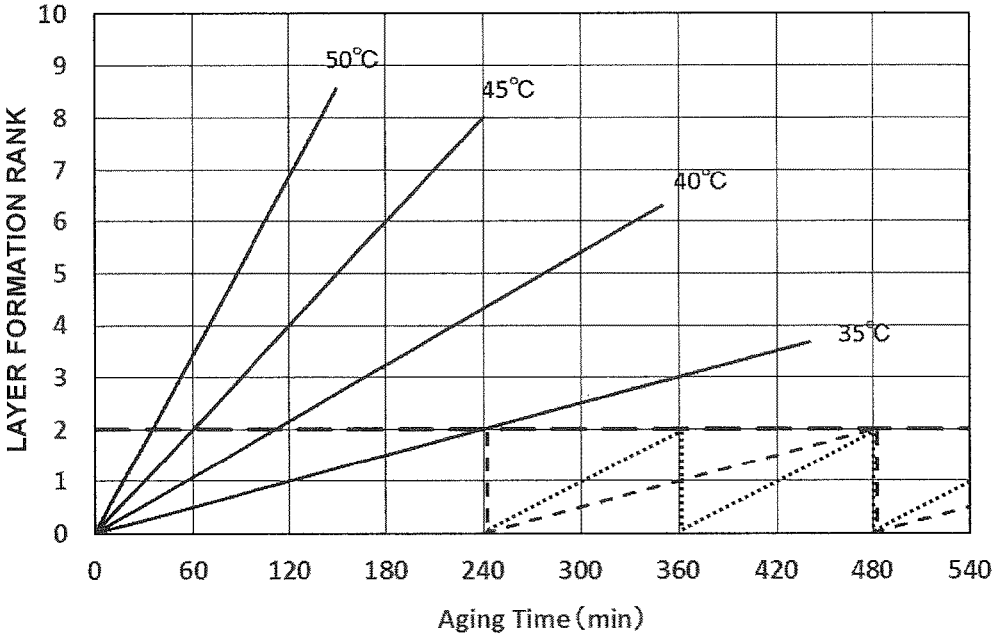
FIG. 19 is a chart which compares the frequency of performing the first developer eliminating mode when the degree of toner degradation in FIG. 16 is less than 1 with a case where it equals 2.

FIG. 19 is a chart which compares the frequency of performing the first developer eliminating mode when the degree of toner degradation in FIG. 16 is less than 1 with a case where it equals 2. For example, when the degree of toner degradation equals 2, the toner degradation coefficient α is doubled, and thus the calculated drive time Tcall is doubled; thus, when the drive time Tst=120 mins, the level of agglomeration reaches level 2. As a result, as indicated by a dotted line in FIG. 19, the first developer eliminating mode is performed at intervals of 120 mins. Specifically, compared to a case where the degree of toner degradation is less than 1 (indicated by a broken line in FIG. 19), the frequency of performing the first developer eliminating mode is higher (doubled).

Figure 20:
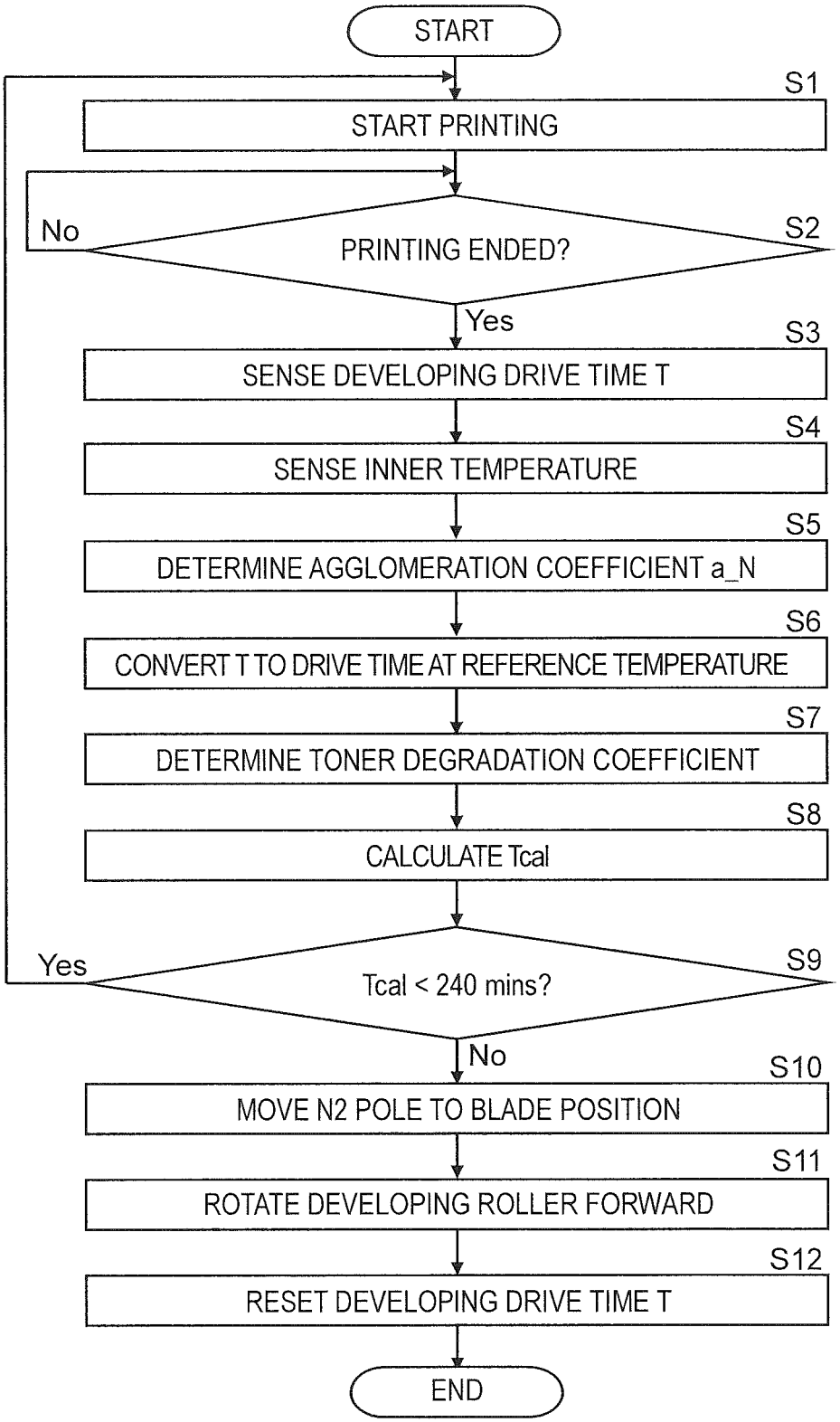
FIG. 20 is a flow chart showing an example of control in the first developer eliminating mode on the developing device according to a third embodiment of the present disclosure.

FIG. 20 is a flow chart showing an example of control in the first developer eliminating mode on the developing device 4 according to the third embodiment of the present disclosure. With reference also to FIGS. 1 to 6 and 16 to 19 as necessary, the procedure for performing the first developer eliminating mode will be described along the steps in FIG. 20.

When a printing instruction is input from a host device such as a PC and printing is started (step S1), the control portion 90 (see FIG. 6) checks whether printing continues or not (step S2). When printing has not ended (No in step S2), printing is continued.

When printing has ended (Yes in Step S2), the developing drive time T counted by the timer 97 is sensed (step S3). Also, by the inner temperature/humidity sensor 61 (see FIG. 6), the inner temperature is sensed (step S4). Then, based on the sensed developing drive time T and inner temperature, the agglomeration coefficient a_N is determined (step S5).

Also, using formula (1), the developing drive time T is converted into the drive time Tst at the reference temperature S (35° C.) (step S6). Furthermore, based on the printing rate and the cumulative drive time Tsum of the developing device 4, the toner degradation coefficient α is determined (step S7), and the calculated drive time Tcal is calculated using formula (2) (step S8).

The control portion 90 checks whether the calculated drive time Tcal is less than a threshold value (here, 240 mins) or not (step S9). When the calculated drive time Tcal is less than 240 mins (Yes in step S9), the procedure returns to step S1 and printing is restarted. When the calculated drive time Tcal is equal to or more than 240 mins (No is step S9), the N2 pole 27*d* is moved to a position facing the regulating blade 29 (step S10) and the developing roller 25 is rotated in the forward direction (in the counter-clockwise direction in FIG. 8) (step S11), and thereby the first developer eliminating mode is performed. Then, the developing drive time T is reset (step S12) and the procedure is finished.

According to the control shown in FIG. 20, the first developer eliminating mode is performed according to the calculated drive time Tcal which is calculated based on the developing drive time T during the latest execution of the first developer eliminating mode and the toner degradation coefficient. Specifically, the first developer eliminating mode is performed at an appropriate frequency reflecting the degree of toner degradation. It is thus possible to effectively prevent clogging with toner at the regulating portion 30 and the resulting vertical streaks in images.

As in the second embodiment, it is possible to perform the second developer eliminating mode subsequently to the first developer eliminating mode. After the level of agglomeration reaches the second level (here, level 3) which is higher than the first level (level 2), when the developing device 4 operates for a given period, at least one of an indication of the life of the developing device 4 or one requesting the replacement of the developing device 4 is displayed on the liquid crystal display portion 71. This prevents the developing device 4 from being used with toner degraded for a long time, and thus makes it possible to prevent clogging with toner at the regulating portion 30 and vertical streaks in images resulting from degraded toner.

Figure 21:
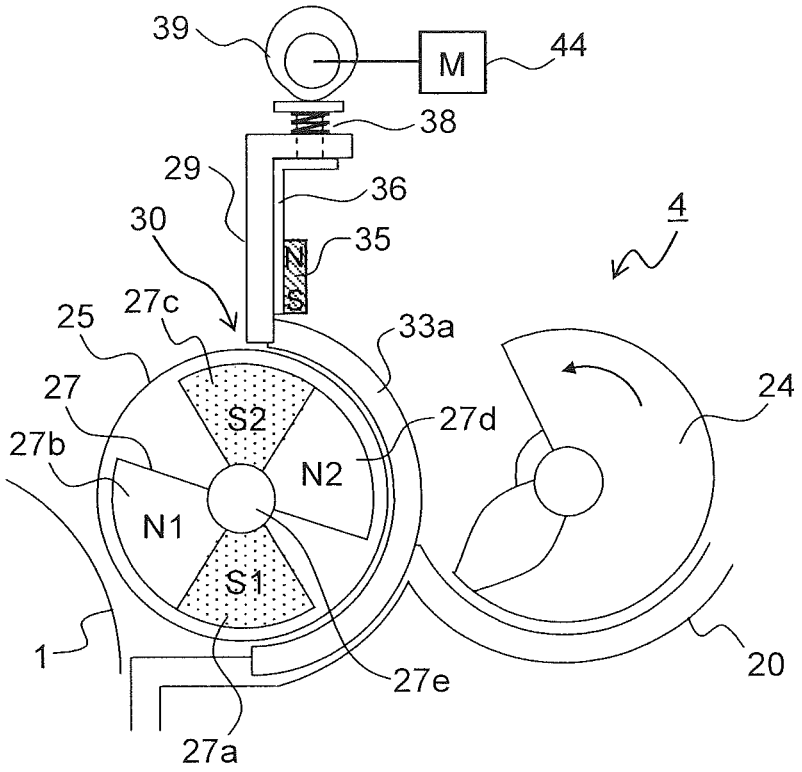
FIG. 21 is an enlarged view of and around the developing roller in the developing device according to a fourth embodiment of the present disclosure.

FIG. 21 is an enlarged view of and around the developing roller 25 in the developing device 4 according to a fourth embodiment of the present disclosure. In the developing device 4 according to the fourth embodiment, as shown in FIG. 21, the blade magnet 35 is fixed to a magnet supporting stay 36. The magnet supporting stay 36 is supported on the rear face side (right side in FIG. 21) of the regulating blade 29 so as to be movable vertically. In other respects, the configuration of the developing device 4 here is similar to that in the first embodiment shown in FIGS. 1 to 5, and thus no overlapping description will be repeated.

Figure 25:
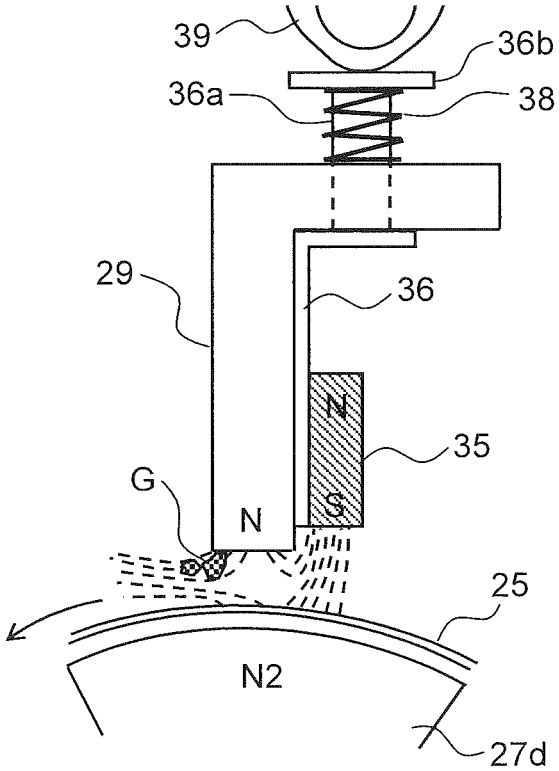
FIG. 25 is a partly enlarged view showing the direction of the magnetic field around the regulating portion in FIG. 24.

Provided on the top face of the magnet supporting stay 36 are a shaft 36*a* penetrating the top face of the regulating blade 29 and a pressed face 36*b* fixed to the top end of the shaft 36*a* and having a larger diameter than the shaft 36*a* (see FIG. 25 for both). A coil spring 38 is fitted around the shaft 36*a* and is clamped between the top face of the regulating blade 29 and the pressed face 36*b*.

Over the regulating blade 29, an eccentric cam 39 is arranged. When the eccentric cam 39 rotates while in contact with the pressed face 36*b*, the pressing force of the eccentric cam 39 and the biasing force of the coil spring 38 vertically move the blade magnet 35 along with the magnet supporting stay 36. The eccentric cam 39 is coupled to a blade magnet moving motor 44. The shaft 36*a*, the pressed face 36*b*, the coil spring 38, and the eccentric cam 39 are provided at least at each end of the regulating blade 29 in its longitudinal direction (the direction perpendicular to the plane in FIG. 21).

The blade magnet 35 is, during image formation, arranged at a reference position (position in FIG. 21) where the tip-end edge of the facing magnetic pole 35*a* is located inward of the tip end of the regulating blade 29 (outward of the developing roller 25 in its radial direction).

Figure 22:
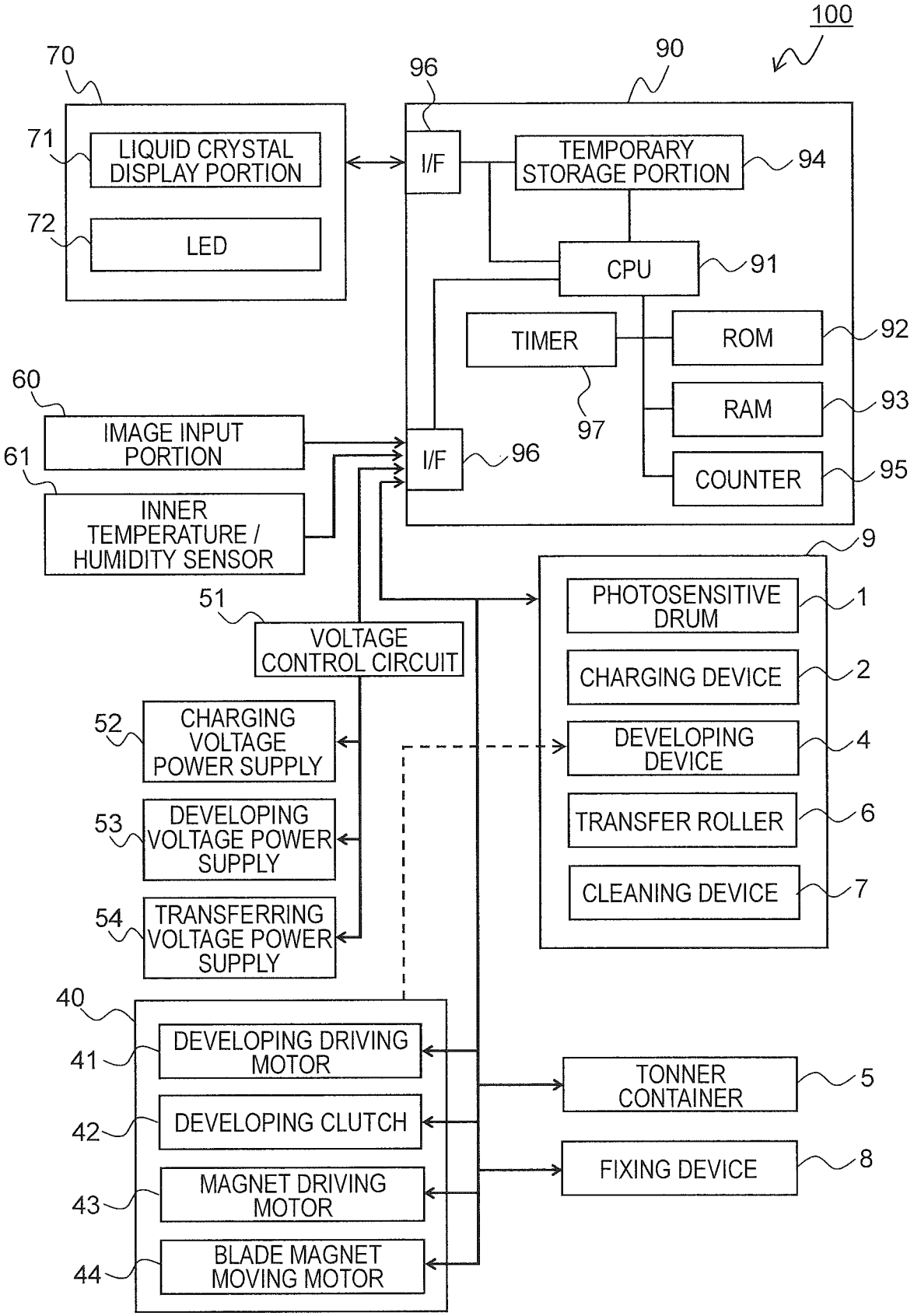
FIG. 22 is a block diagram showing one example of control paths used in the image forming apparatus provided with the developing device of the fourth embodiment.

FIG. 22 is a block diagram showing one example of control paths used in the image forming apparatus 100 provided with the developing device 4 of the fourth embodiment. As shown in FIG. 22, the developing driving portion 40 includes the developing drive motor 41, the developing clutch 42, the magnet drive motor 43, and the blade magnet moving motor 44. The blade magnet moving motor 44 rotates the eccentric cam 39 to vertically move the blade magnet 35 along with the magnet supporting stay 36. In other respects, the control paths here are configured similarly to those shown in FIG. 6, and thus no overlapping description will be repeated.

Figure 23:
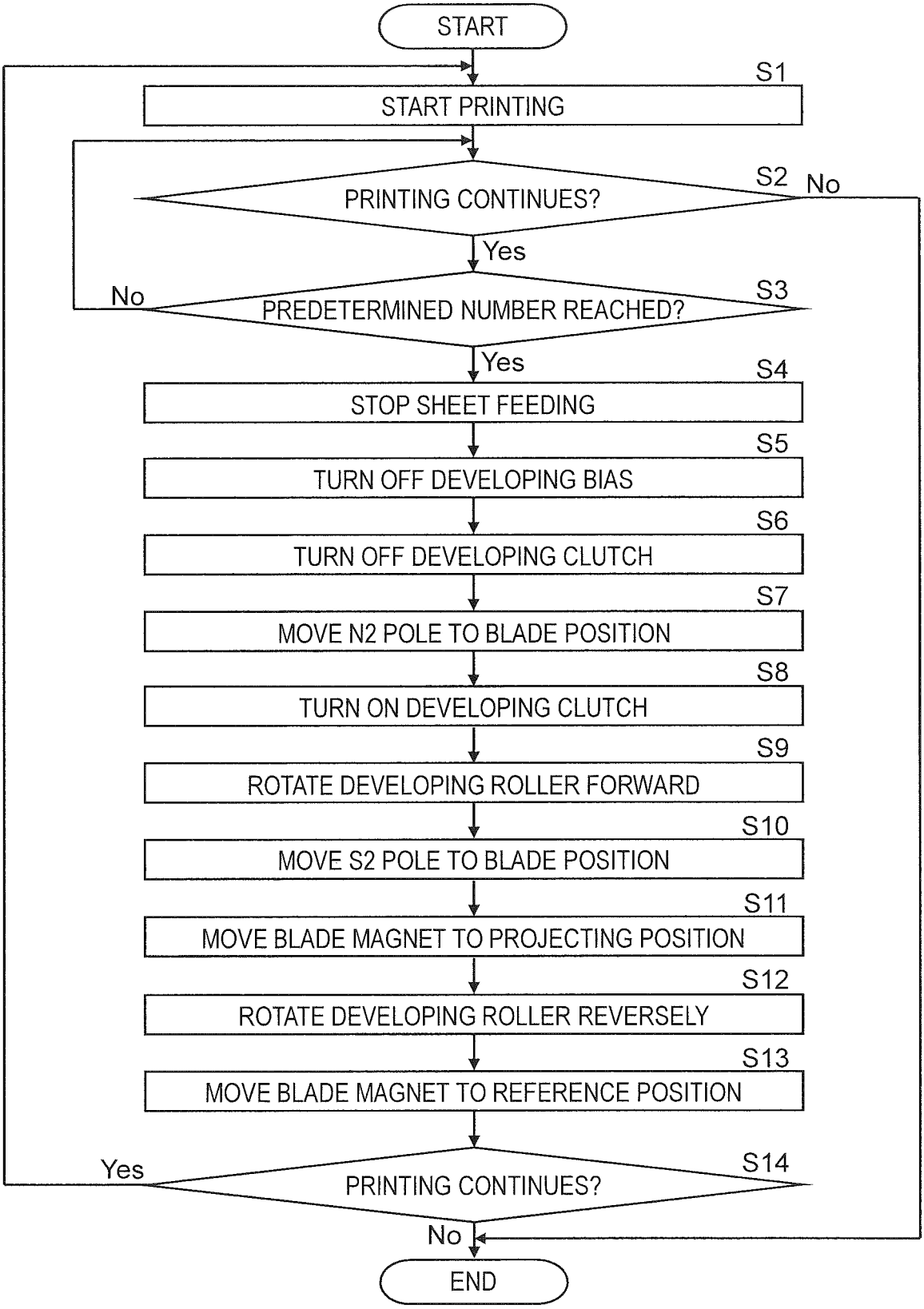
FIG. 23 is a flow chart showing an example of control in a developer eliminating mode on the developing device of the fourth embodiment.

FIG. 23 is a flow chart showing an example of control in a developer eliminating mode on the developing device 4 of the fourth embodiment. With reference also to FIGS. 1 to 3, 21, and 22 as necessary, the procedure for performing the developer eliminating mode will be described along the steps in FIG. 23.

When a printing instruction is input from a host device such as a PC and printing is started (step S1), the control portion 90 (see FIG. 22) checks whether printing continues or not (step S2). When printing continues, whether the number of printed sheets has reached a predetermined number or not is checked next (step S3). When the number of printed sheets has not reached the predetermined number (No in step S3), the procedure returns to step S2 and printing is continued. When printing ends before the number of printed sheets reaches the predetermined number (No in step S2), the procedure is finished.

When the number of printed sheets has reached the predetermined number (Yes in Step S3), sheet feeding from the sheet storage portion 10 is stopped according to a control signal from the control portion 90 (step S4). Application of a developing bias from the developing voltage power supply 53 (see FIG. 22) to the developing roller 25 is stopped (step S5), and the developing clutch 42 (see FIG. 22) is turned off (step S6) to stop the rotation of the developing roller 25.

Then, a control signal is transmitted from the control portion 90 to the magnet drive motor 43 (see FIG. 22) to make the fixed magnet 27 rotate through a predetermined angle in the rotation direction (the forward direction, the counter-clockwise direction in FIG. 21) of the developing roller 25 during image formation and move to a position where the N2 pole (scooping pole) 27*d* faces the regulating blade 29 (the second position) (step S7).

Figure 24:
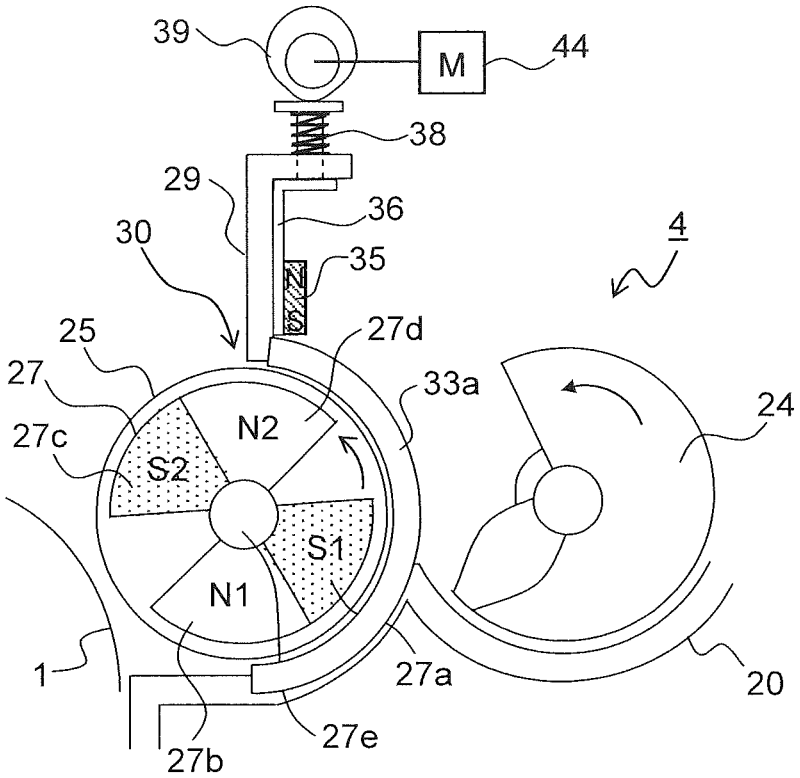
FIG. 24 is an enlarged view of and around the developing roller of the developing device, showing a state where the N2 pole of the fixed magnet has been moved to a position facing the regulating blade.

FIG. 24 is an enlarged view of and around the developing roller 25 in the developing device 4, showing a state where the N2 pole 27*d* of the fixed magnet 27 has been moved to a position facing the regulating blade 29. FIG. 25 is a partly enlarged view showing the direction of the magnetic field around the regulating portion 30 in FIG. 24. When the N2 pole 27*d* is arranged to face the regulating blade 29, as shown in FIG. 25, lines of magnetic force (indicated by broken lines in FIG. 25, a repulsive magnetic field) appear between the N pole induced at the tip end of the regulating blade 29 and the N2 pole 27*d*. Next, in the state in FIG. 24, the developing clutch 42 (see FIG. 22) is turned on (step S8), and the developing roller 25 is rotated in the forward direction (counter-clockwise direction in FIG. 24) (step S9) to perform the first developer eliminating mode.

With this, as shown in FIG. 25, a force in the rotation direction of the developing roller 25 acts on the toner agglomerate G attached to the tip end of the regulating blade 29. As a result, the toner agglomerate G is eliminated from the tip end of the regulating blade 29. Here, the blade magnet 35 is arranged at the reference position where the tip-end edge of the facing magnetic pole 35*a* is located inward of the tip end of the regulating blade 29. This makes it easier to eliminate the toner agglomerate G attached to the tip end of the regulating blade 29.

Figure 26:
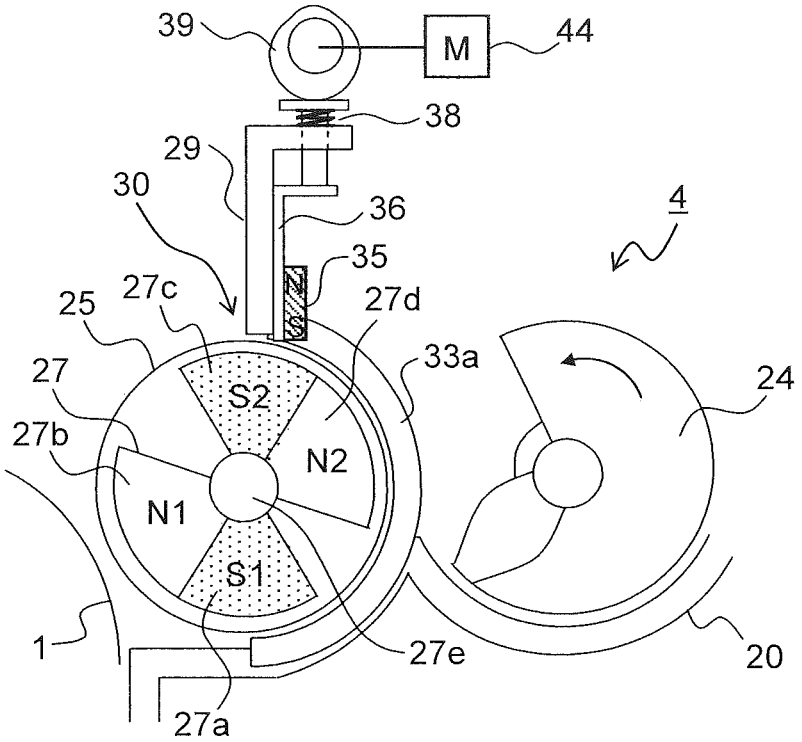
FIG. 26 is an enlarged view of and around the developing roller of the developing device, showing a state where the S2 pole of the fixed magnet has been moved to a position facing the regulating blade.

Next, the fixed magnet 27 is rotated from the state in FIG. 24 in the reverse direction (clockwise direction in FIG. 24) to be arranged at the first position where, as shown in FIG. 26, the S2 pole 27*c* faces the regulating blade 29 (step S10). Furthermore, a control signal is transmitted from the control portion 90 to the blade magnet moving motor 44, and the eccentric cam 39 is rotated so that the large-diameter portion of the eccentric cam 39 makes contact with the pressed face 36*b*. With this, the blade magnet 35 is, along with the magnet supporting stay 36, arranged at a projecting position where the tip-end edge of the facing magnetic pole 35*a* projects outward of the tip end of the regulating blade 29 (inward of the developing roller 25 in its radial direction) (step S11). Then, in that state, the developing roller 25 is rotated in the reverse direction compared with during the image formation (clockwise direction in FIG. 26) (step S12) to perform the second developer eliminating mode.

Figure 27:
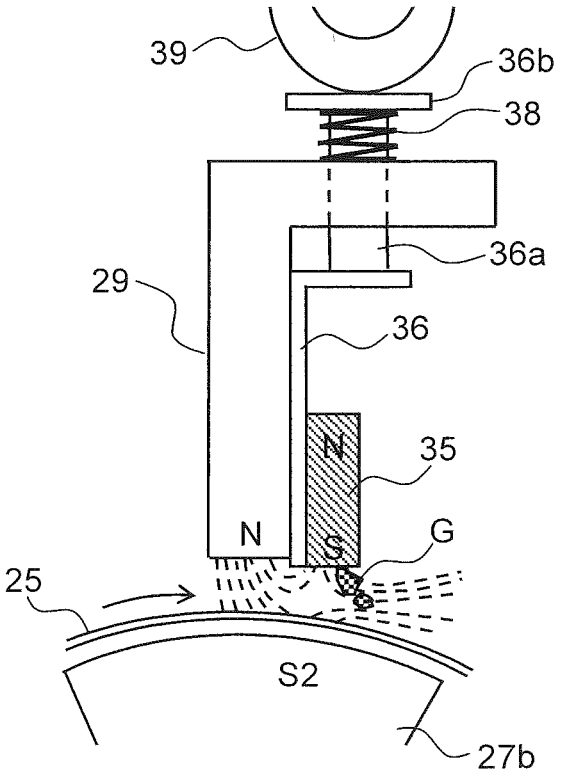
FIG. 27 is a partly enlarged view showing the direction of the magnetic field around the regulating portion in FIG. 26.

FIG. 26 is an enlarged view of and around the developing roller 25 in the developing device 4 of this embodiment, showing a state where the S2 pole 27*c* of the fixed magnet 27 in the developing device 4 has been moved to a position facing the regulating blade 29. FIG. 27 is a partly enlarged view showing the direction of the magnetic field around the regulating portion 30 in FIG. 26.

By arranging the S2 pole 27*c* having the same polarity as the facing magnetic pole 35*a* of the blade magnet 35 (a polarity different from that induced at the tip end of the regulating blade 29) at a position facing the regulating blade 29, as shown in FIG. 27, a repulsive magnetic field is generated between the blade magnet 35 and the developing roller 25. In this state, by rotating the developing roller 25 reversely, a force in the rotation direction of the developing roller 25 acts on the toner agglomerate G around the blade magnet 35. As a result, the toner agglomerate G is eliminated from the tip end of the blade magnet 35.

Here, the blade magnet 35 is arranged at the projecting position where the tip-end edge of the facing magnetic pole 35*a* projects outward of the tip end of the regulating blade 29. Thus, the toner agglomerate G stagnating in a stepped part between the regulating blade 29 and the blade magnet 35 is pushed out to the developing roller 25 side, and this makes it easier to eliminate by the developing roller 25 in reverse rotation the pushed-out toner agglomerate G.

Then, a control signal is transmitted from the control portion 90 to the blade magnet moving motor 44, and the eccentric cam 39 is rotated so that the small-diameter portion of the eccentric cam 39 makes contact with the pressed face 36*b*. This makes the blade magnet 35 move to the reference position (see FIG. 21) again (step S13). The control portion 90 checks whether printing continues or not (step S14), and when printing continues (Yes in step S14), the procedure returns to step S1 to restart printing. When printing has ended (No in step S14), the procedure is finished.

According to the control shown in FIG. 23, by making the developing roller 25 rotate forward with the repulsive magnetic field generated between the regulating blade 29 and the developing roller 25, the toner agglomerate G attached to the tip end of the regulating blade 29 moves to the developing roller 25 side and attaches to it. The toner agglomerate G attached to the developing roller 25 rotates and moves downward by following the developing roller 25, and is collected into the housing 20 from the bottom end part of the developing roller 25.

In particular, when a low melt toner with a glass transition point (Tg) of 55° C. or lower is used in a developing system where the developing roller 25 has a line speed (processing speed) of 500 mm/sec or higher, even when continuous printing in a high-temperature environment is repeated, no toner agglomerate G stagnates at the regulating portion 30, thus suppressing blocking with toner due to heat and mechanical stress. It is thus possible to effectively prevent clogging with toner at the regulating portion 30 and the resulting image failure such as white streaks and vertical gray streaks.

By performing the second developer eliminating mode subsequently to the first developer eliminating mode, the toner agglomerate G attached to the tip end of the regulating blade 29 and the toner agglomerate G attached to the tip end of the blade magnet 35 can both be eliminated effectively. Furthermore, when the second developer eliminating mode is performed, by moving the blade magnet 35 from the reference position to the projecting position, the toner agglomerate G stagnating in a stepped part between the regulating blade 29 and the blade magnet 35 is pushed out by the blade magnet 35, and thus the toner agglomerate G can be eliminated effectively.

Figure 28:
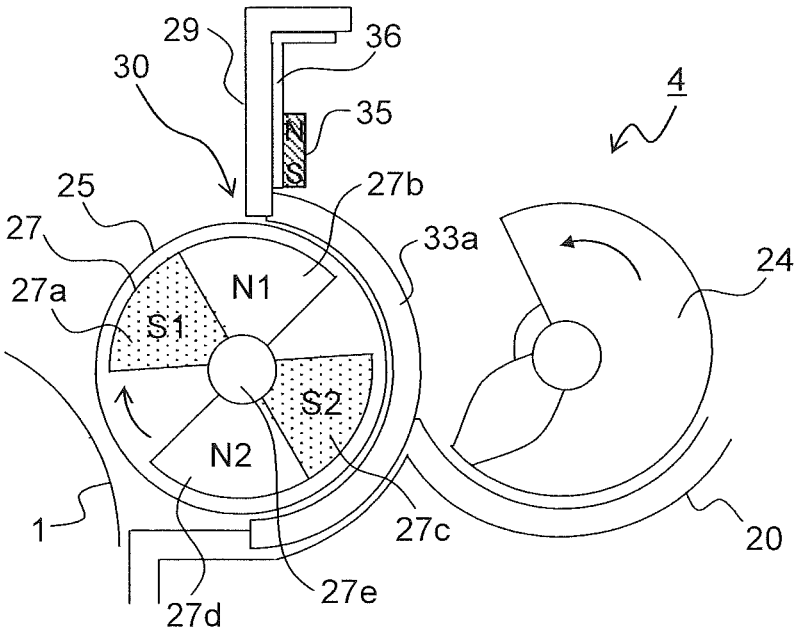
FIG. 28 is an enlarged view of and around the developing roller of the developing device, showing a state where the fixed magnet is rotated in the reverse direction to move the N1 pole to a position facing the regulating blade.

In the example of control in FIG. 23, when the first developer eliminating mode is performed, the fixed magnet 27 is rotated in the forward direction (counter-clockwise direction in FIG. 24) to arrange the N2 pole 27*d* at a position facing the regulating blade 29. Instead, as shown in FIG. 28, the fixed magnet 27 may be rotated in the reverse direction (the clockwise direction in FIG. 24) to arrange the N1 pole (main pole) 27*b* at a position facing the regulating blade 29.

Figure 29:
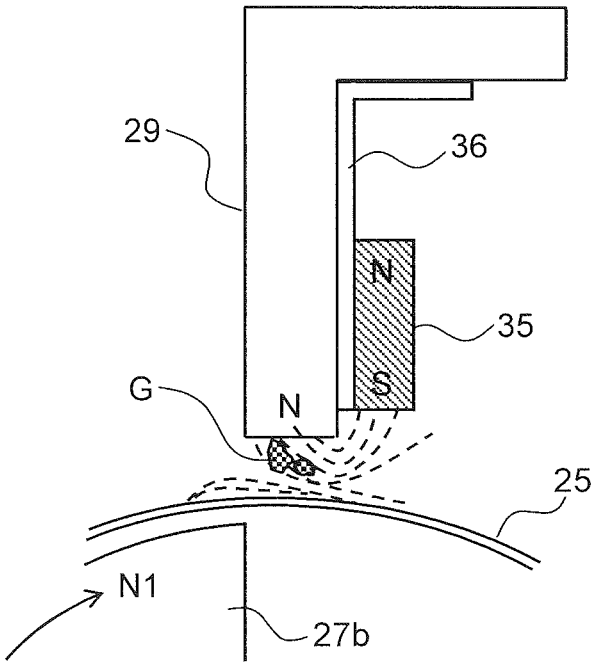
FIG. 29 is a partly enlarged view showing the direction of the magnetic field around the regulating portion when the fixed magnet is rotated in the reverse direction, illustrating a state where the N1 pole is approaching the regulating portion.
Figure 30:
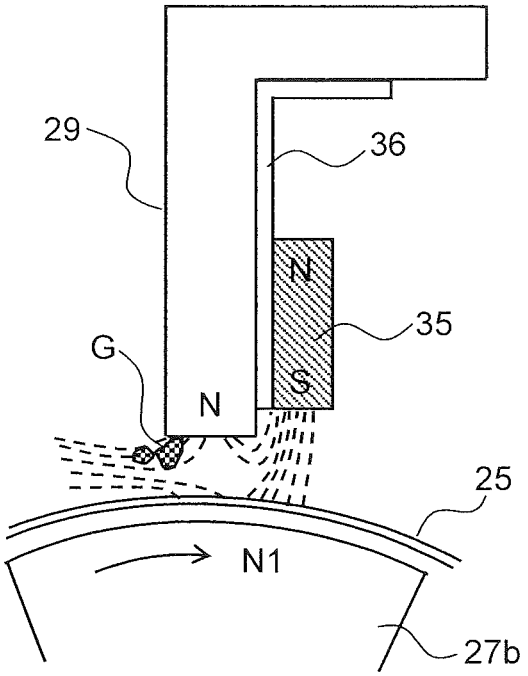
FIG. 30 is a partly enlarged view showing the direction of the magnetic field around the regulating portion when the fixed magnet is rotated in the reverse direction, illustrating a state where the N1 pole has passed the regulating portion.

FIGS. 29 and 30 are partly enlarged views showing the direction of the magnetic field around the regulating portion 30 when the fixed magnet 27 is rotated in the reverse direction, respectively illustrating a state where the N1 pole 27*b* is approaching the regulating portion 30 and a state where the N1 pole 27*b* has passed the regulating portion 30. In FIGS. 28 to 30, the shaft 36*a*, the pressed face 36*b*, the coil spring 38, and the eccentric cam 39 are omitted from illustration.

When the N1 pole 27*b* approaches the regulating portion 30 from the reverse direction (the left direction in FIG. 28), as shown in FIG. 29, lines of magnetic force (repulsive magnetic field) pointing inward of the developing device 4 (toward the right direction in FIG. 29) appear between the N pole induced at the tip end of the regulating blade 29 and the N1 pole 27*b*. By this repulsive magnetic field, the toner agglomerate G attached to the tip end of the regulating blade 29 is swung inward of the developing device 4 momentarily.

When the fixed magnet 27 rotates further in the reverse direction from the state in FIG. 29 and the N1 pole 27*b* passes the regulating portion 30, as shown in FIG. 30, the direction of the magnetic field between the N pole induced at the tip end of the regulating blade 29 and the N1 pole 27*b* is reversed, and lines of magnetic force (repulsive magnet field) pointing outward of the developing device 4 (toward the left direction in FIG. 30) appear. By this repulsive magnetic field, the toner agglomerate G is now swung outward of the developing device 4. In this way, the toner agglomerate G vibrates according to the change in the magnetic field, and thus a loosening effect through vibration can be expected, and this makes it easier to eliminate the toner agglomerate G when the developing roller 25 is rotated forward.

While the first developer eliminating mode is performed, as shown in FIG. 28, if the fixed magnet 27 is rotated in the reverse direction (clockwise direction) to arrange the N1 pole (main pole) 27*b* at a position facing the regulating blade 29, when the second developer eliminating mode is performed, the fixed magnet 27 is rotated forward (in the counter-clockwise direction) to arrange the S2 pole 27*c* at a position facing the regulating blade 29.

Here, the S2 pole 27*c* approaches the facing magnetic pole 35*a* (S pole) of the blade magnet 35 from inside the developing device 4, and thus a repulsive magnetic field pointing outward of the developing device 4 is generated between the facing magnetic pole 35*a* and the S2 pole 27*c*. With this, the toner agglomerate G attached to the tip end of the blade magnet 35 is swung outward of the developing device 4 (toward the left direction in FIG. 30) momentarily. Then, when the S2 pole 27*c* passes the blade magnet 35, the direction of the repulsive magnetic field is reversed to point inward of the developing device 4 (toward the right direction in FIG. 30), and thereby the toner agglomerate G is now swung inward of the developing device 4. Thus, a loosening effect through vibration can be expected, and this makes it easier to eliminate the toner agglomerate G when the developing roller 25 is rotated reversely.

Furthermore, how frequently the first developer eliminating mode is performed may be changed according to the detection result from the inner temperature/humidity sensor 61. Specifically, by performing the first developer eliminating mode more frequently (shortening the interval) as the inner temperature becomes higher, it is possible to suppress agglomeration of toner and to prevent image failure effectively.

Instead of the inner temperature/humidity sensor 61, an outer temperature sensor for sensing the temperature outside the image forming apparatus 100 (the outer temperature) may be provided and the frequency of performing the first developer eliminating mode may be changed according to the temperature outside the device sensed by the outer temperature sensor.

Next, a fifth embodiment of the present disclosure will be described. In the fifth embodiment, the timing of performing the first developer eliminating mode is determined based on the developing drive time T. Specifically, in a similar manner as in the third embodiment shown in FIGS. 16 to 19, based on the developing drive time T, whether the level of agglomeration has reached a first level (here, level 2) or not is checked, and when it reaches the first level, the first developer eliminating mode is performed.

Figure 31:
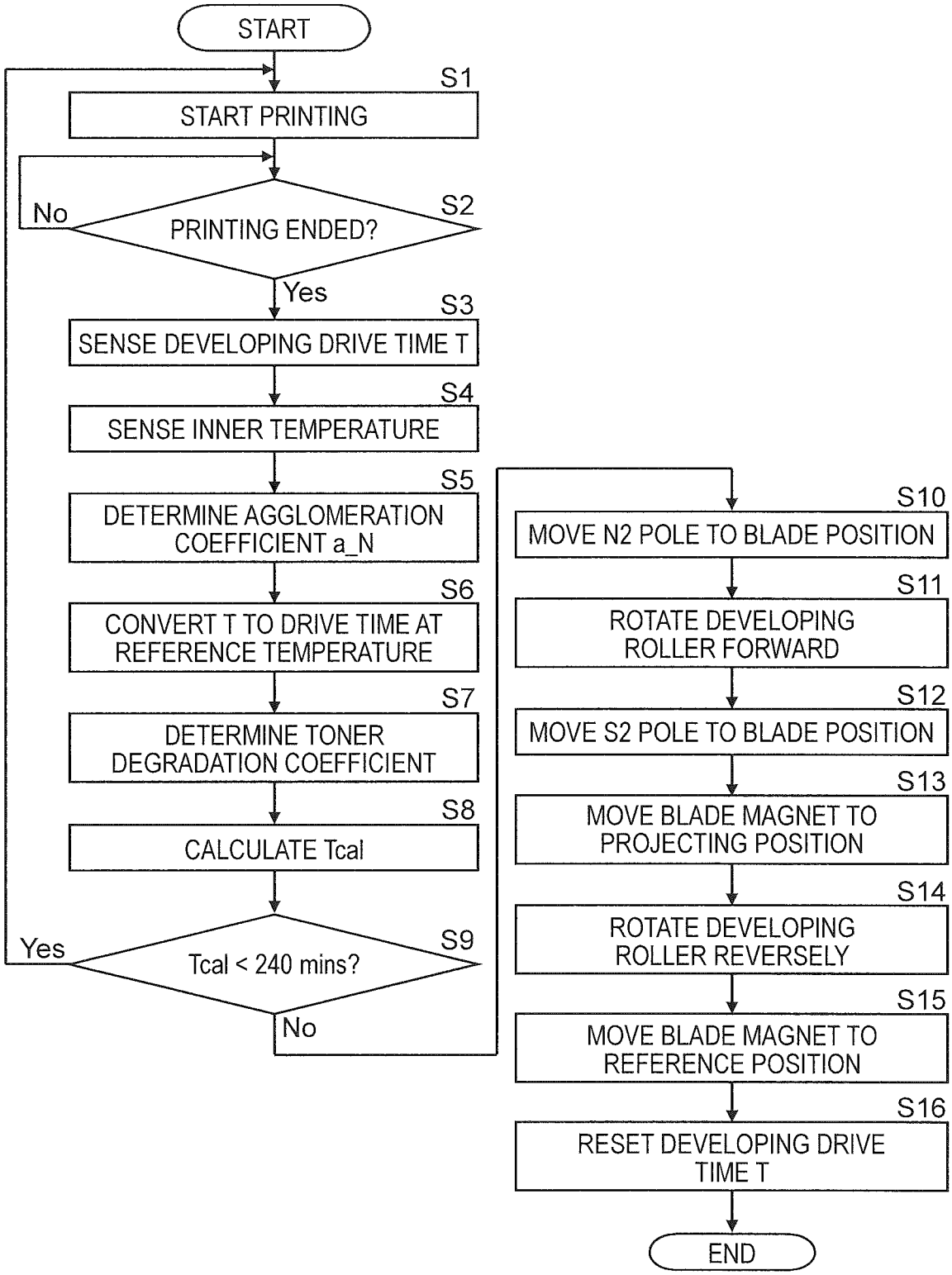
FIG. 31 is a flow chart showing an example of control in the developer eliminating mode on the developing device according to a fifth embodiment of the present disclosure.

FIG. 31 is a flow chart showing an example of control in the developer eliminating mode on the developing device 4 according to the fifth embodiment of the present disclosure. With reference also to FIGS. 1 to 3, 16 to 19, 21, and 22 as necessary, the procedure for performing the developer eliminating mode will be described along the steps in FIG. 31.

When a printing instruction is input from a host device such as a PC and printing is started (step S1), the control portion 90 (see FIG. 22) checks whether printing continues or not (step S2). When printing has not ended (No in step S2), printing is continued.

When printing has ended (Yes in Step S2), the developing drive time T counted by the timer 97 is sensed (step S3). Also, by the inner temperature/humidity sensor 61 (see FIG. 22), the inner temperature is sensed (step S4). Then, based on the sensed developing drive time T and inner temperature, the agglomeration coefficient a_N is determined (step S5).

Also, using formula (1), the developing drive time T is converted into the drive time Tst at the reference temperature S (35° C.) (step S6). Furthermore, based on the printing rate and the cumulative drive time Tsum of the developing device 4, the toner degradation coefficient $\alpha$ is determined (step S7), and the calculated drive time Tcal is calculated using formula (2) (step S8).

The control portion 90 checks whether the calculated drive time Tcal is less than a threshold value (here, 240 mins) or not (step S9). When the calculated drive time Tcal is less than 240 mins (Yes in step S9), the procedure returns to step S1 and printing is restarted. When the calculated drive time Tcal is equal to or more than 240 mins (No is step S9), the N2 pole 27*d* is moved to a position facing the regulating blade 29 (step S10) and the developing roller 25 is rotated in the forward direction (in the counter-clockwise direction in FIG. 24) (step S11), and thereby the first developer eliminating mode is performed.

Next, by moving the S2 pole 27*c* to a position facing the regulating blade 29 (step S12) and moving the blade magnet 35 to the projecting position (step S13), and then rotating the developing roller 25 in the reverse direction (clockwise direction in FIG. 24) (step S14), the second developer eliminating mode is performed. Then, the blade magnet 35 is moved to the reference position (step S15) and the developing drive time T is reset (step S16), and the procedure is finished.

According to the control shown in FIG. 31, the developer eliminating mode is performed according to the calculated drive time Tcal which is calculated based on the developing drive time T during the latest execution of the developer eliminating mode and the toner degradation coefficient. That is, the developer eliminating mode is performed at an appropriate frequency reflecting the degree of toner degradation. It is thus possible to effectively prevent clogging with toner at the regulating portion 30 and the resulting vertical streaks in images.

After the level of agglomeration reaches the second level (here, level 3) which is higher than the first level (level 2), when the developing device 4 operates for a given period, at least one of an indication of the life of the developing device 4 or one requesting the replacement of the developing device 4 is displayed on the liquid crystal display portion 71. This prevents the developing device 4 from being used with toner degraded for a long time, and thus makes it possible to prevent clogging with toner at the regulating portion 30 and vertical streak lines in images resulting from degraded toner.

The embodiments described above are in no way meant to limit the present disclosure, which thus allows for many modifications and variations within the spirit of the present disclosure. For example, in the above embodiments, the fixed magnet 27 is configured to have four poles, namely two N poles and two S poles. The present disclosure is applicable similarly to a fixed magnet 27 configured to have five or three poles.

In the fourth and fifth embodiments described above, the second developer eliminating mode is performed after the execution of the first developer eliminating mode. However, the first developer eliminating mode can be performed also after the execution of the second developer eliminating mode. The fourth and fifth embodiments described above are configured such that the blade magnet 35 is moved to the reference position and the projecting position by the coil spring 38, the eccentric cam 39, and the blade magnet moving motor 44. However, the moving mechanism for the blade magnet 35 is not limited to this, and any well-known mechanism such as a solenoid or a rack-and-pinion mechanism can be used.

The present disclosure is applicable to a developing device which uses magnetic one-component developer and a developer carrier used in such a developing device. Based on the present disclosure, it is possible to provide a developing device which can prevent clogging with toner even when continuous printing is performed in a high-temperature environment, and to provide an image forming apparatus provided with such a developing device.

What is claimed is:

1. A developing device comprising:

a housing which stores magnetic developer;

a developer carrier which is rotatably supported on the housing to carry the developer on an outer circumferential face thereof;

a regulating blade which is formed of a magnetic material and is arranged at a predetermined interval from the developer carrier, the regulating blade forming a regulating portion for regulating layer thickness of the developer carried on the developer carrier;

a magnetic member having a shaft arranged inside the developer carrier and a plurality of magnetic poles including an S pole and an N pole fixed to an outer circumferential face of the shaft; and a blade magnet fixed to the regulating blade to induce a magnetic pole at a tip end of the regulating blade, the developing device developing an electrostatic latent image formed on an image carrier, wherein the magnetic member is movable between a first position where a magnetic pole having a same polarity as a polarity of a facing magnetic pole of the blade magnet facing the developer carrier is arranged at the regulating portion and a second position where a magnetic pole having a different polarity from the polarity of the facing magnetic pole is arranged at the regulating portion, and a first developer eliminating mode can be performed in which the developer stagnating at the regulating portion is eliminated by, during non-image forming period, moving the magnetic member from the first position to the second position and rotating the developer carrier in a forward direction which is a rotation direction during image formation.

2. The developing device according to claim 1, wherein a second developer eliminating mode can be performed in which, after the first developer eliminating mode is performed, the developer stagnating between the blade magnet and the developer carrier is eliminated by moving the magnetic member from the second position to the first position and by rotating the developer carrier in a reverse direction which is a direction opposite to the forward direction.

3. The developing device according to claim 2, wherein the blade magnet is movable between a reference position where a tip end of the facing magnetic pole is arranged outward of the tip end of the regulating blade in a radial direction of the developer carrier and a projecting position where the tip end of the facing magnetic pole projects inward of the tip end of the regulating blade in the radial direction of the developer carrier, and the developing device can perform developer eliminating modes including the first developer eliminating mode in which the developer stagnating at the regulating portion is eliminated by, during non-image forming period, rotating the developer carrier in the forward direction which is the rotation direction during image formation in a state where the magnetic member is arranged at the second position and the blade magnet is arranged at the reference position, and the second developer eliminating mode in which the developer stagnating between the blade magnet and the developer carrier is eliminated by rotating the developer carrier in the reverse direction which is the direction opposite to the forward direction in a state where the magnetic member is arranged at the first position and the blade magnet is arranged at the projecting position.

4. The developing device according to claim 3, further comprising:

a magnet supporting stay which is supported on an upstream side of the regulating blade in the forward direction so as to be movable vertically and to which the blade magnet is fixed;

a shaft which is fixed to a top face of the magnet supporting stay and which penetrates a top face of the regulating blade;

a coil spring which is fitted around the shaft and which is clamped between the top face of the regulating blade and a pressed face fixed to a top end of the shaft and having a larger diameter than the shaft; and an eccentric cam which rotates while remaining in contact with the pressed face, wherein the blade magnet is moved along the magnet supporting stay between the reference position and the projecting position by a pressing force due to rotation of the eccentric cam and by a biasing force of the coil spring.

5. The developing device according to claim 1, wherein the magnetic member is, during performance of the first developer eliminating mode, rotated in the reverse direction which is a direction opposite to the forward direction to move the magnetic member from the first position to the second position.

6. The developing device according to claim 2, wherein the magnetic member is, during performance of the second developer eliminating mode, rotated in the forward direction to move the magnetic member from the second position to the first position.

7. The developing device according to claim 1, wherein a rotation speed of the developer carrier during image formation is 500 mm/sec or higher.

8. The developing device according to claim 1, wherein the developer is magnetic one-component developer containing magnetic toner alone.

9. An image forming apparatus comprising the developing device according to claim 1.

10. The image forming apparatus according to claim 9, further comprising:

a time counting portion which separately counts a first drive time Tsum which is a cumulative drive time after a start of use of the developing device and a second drive time T which is a cumulative drive time after execution of the first developer eliminating mode; and a control portion which controls the developing device, wherein the control portion, based on the second drive time T counted by the time counting portion, checks whether a level of agglomeration has reached a first level or not and performs the first developer eliminating mode when the level of agglomeration has reached the first level.

11. The image forming apparatus according to claim 10, further comprising a temperature sensing device which senses temperature inside or outside the image forming apparatus, wherein the control portion, based on formula (1) below, converts the second drive time T at a temperature N sensed by the temperature sensing device into a drive time Tst at a reference temperature S, and judges whether the level of agglomeration has reached the first level or not based on the drive time Tst:

$$Tst=T\times(a_N/a_S) \quad (1)$$

where a_S is an agglomeration coefficient at the reference temperature S, and a_N is the agglomeration coefficient at the temperature N.

12. The image forming apparatus according to claim 11, wherein the control portion, based on a formula (2) below, calculates a calculated drive time Tcal reflecting a level of degradation of the developer and judges whether the level of agglomeration has reached the first level or not based on the calculated drive time Tcal:

$$Tcal=T\times(a_N/a_S)\times\alpha \quad (2)$$

where $\alpha$ is a toner degradation coefficient.

13. The image forming apparatus according to claim 10, further comprising a display device which can display an indication of a life of the developing device predicted based on the level of agglomeration or an indication requesting replacement of the developing device, wherein when the developing device operates for a given period after the level of agglomeration reaches a second level which is higher than the first level, the control portion displays, using the display device, at least one of the indication of the life of the developing device or the indication requesting replacement of the developing device.

* * * * *